US008783179B2

(12) United States Patent
Kurokawa et al.

(10) Patent No.: US 8,783,179 B2
(45) Date of Patent: Jul. 22, 2014

(54) SUPPORT FOR PLANOGRAPHIC PRINTING PLATE, METHOD FOR PRODUCING SUPPORT FOR PLANOGRAPHIC PRINTING PLATE, AND PLANOGRAPHIC PRINTING ORIGINAL PLATE

(75) Inventors: Shinya Kurokawa, Haibara-gun (JP); Yoshiharu Tagawa, Haibara-gun (JP); Hirokazu Sawada, Haibara-gun (JP); Akio Uesugi, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 186 days.

(21) Appl. No.: 13/519,496

(22) PCT Filed: Dec. 22, 2010

(86) PCT No.: PCT/JP2010/073115

§ 371 (c)(1),
(2), (4) Date: Jun. 27, 2012

(87) PCT Pub. No.: WO2011/081064

PCT Pub. Date: Jul. 7, 2011

(65) Prior Publication Data

US 2012/0298001 A1 Nov. 29, 2012

(30) Foreign Application Priority Data

Dec. 28, 2009 (JP) ..... 2009-297665
Mar. 18, 2010 (JP) ..... 2010-062553
Apr. 30, 2010 (JP) ..... 2010-105485

(51) Int. Cl.
*B41N 1/08* (2006.01)
*B41N 3/03* (2006.01)
*C25D 11/12* (2006.01)

(52) U.S. Cl.
CPC ..... *B41N 1/083* (2013.01); *B41N 3/034* (2013.01); *C25D 11/12* (2013.01)
USPC ..... 101/459; 101/463.1; 430/302

(58) Field of Classification Search
CPC ..... B41N 1/083; B41N 3/034; C25D 11/12; C25D 11/04; B41C 2210/08; G03F 7/09
USPC ..... 101/459, 463.1; 430/302, 278.1; 205/127, 214, 324, 175
See application file for complete search history.

(56) References Cited

U.S. PATENT DOCUMENTS 4,865,951 A 9/1989 Huddleston et al.
(Continued)

FOREIGN PATENT DOCUMENTS

JP 2-057391 A 2/1990
(Continued)

OTHER PUBLICATIONS

International Preliminary Report on Patentability and Written Opinion, mailed Aug. 23, 2012, issued in corresponding International Application No. PCT/JP2010/073115, 6 pages.
(Continued)

*Primary Examiner* — Ren Yan
*Assistant Examiner* — Blake A Tankersley
(74) *Attorney, Agent, or Firm* — Sughrue Mion, PLLC

(57) ABSTRACT

Provided is a lithographic printing plate support that has excellent scratch resistance and is capable of obtaining a presensitized plate which exhibits excellent on-press developability and enables a lithographic printing plate formed therefrom to have a long press life and excellent deinking ability after suspended printing. The lithographic printing plate support includes an aluminum plate, and an aluminum anodized film formed thereon and having micropores which extend in a depth direction of the anodized film from a surface of the anodized film opposite from the aluminum plate. Each micropore has a large-diameter portion which extends to a depth of 5 to 60 nm (depth A) from the anodized film surface, and a small-diameter portion which communicates with the bottom of the large-diameter portion, further extends to a depth of 900 to 2,000 nm from the communication position and has a predetermined average diameter.

20 Claims, 4 Drawing Sheets

(56) References Cited

U.S. PATENT DOCUMENTS

| | | | | |
|---|---|---|---|---|
| 2006/0210926 | A1* | 9/2006 | Sawada et al. | 430/302 |
| 2007/0235342 | A1* | 10/2007 | Matsuo et al. | 205/175 |
| 2011/0000385 | A1* | 1/2011 | Campestrini et al. | 101/463.1 |

FOREIGN PATENT DOCUMENTS

| | | | |
|---|---|---|---|
| JP | 11-291657 | A | 10/1999 |
| JP | 2002-365791 | A | 12/2002 |
| JP | 2007-237397 | A | 9/2007 |

OTHER PUBLICATIONS

Communication, dated Mar. 28, 2014, issued in corresponding EP Application No. 10840921.0, 4 pages in English.

* cited by examiner

SUPPORT FOR PLANOGRAPHIC PRINTING PLATE, METHOD FOR PRODUCING SUPPORT FOR PLANOGRAPHIC PRINTING PLATE, AND PLANOGRAPHIC PRINTING ORIGINAL PLATE

This application is a National Stage of International Application No. PCT/JP2010/073115 filed Dec. 22, 2010, claiming priority based on Japanese Patent Application Nos. 2009-297665, filed Dec. 28, 2009, 2010-062553, filed Mar. 18, 2010 and 2010-105485, filed Apr. 30, 2010, the contents of all of which are incorporated herein by reference in their entirety.

TECHNICAL FIELD

The present invention relates to a lithographic printing plate support, a manufacturing method thereof and a presensitized plate.

BACKGROUND ART

Lithographic printing is a printing process that makes use of the inherent immiscibility of water and oil. Lithographic printing plates used in lithographic printing have formed on a surface thereof regions which are receptive to water and repel oil-based inks (referred to below as "non-image areas") and regions which repel water and are receptive to oil-based inks (referred to below as "image areas").

The aluminum support employed in a lithographic printing plate (referred to below simply as a "lithographic printing plate support") is used in such a way as to carry non-image areas on its surface. It must therefore have a number of conflicting properties, including, on the one hand, an excellent hydrophilicity and water retention and, on the other hand, an excellent adhesion to the image recording layer that is provided thereon. If the hydrophilicity of the support is too low, ink is likely to be attached to the non-image areas at the time of printing, causing a blanket cylinder to be scummed and thereby causing so-called scumming to be generated. In addition, if the water retention of the support is too low, clogging in the shadow area is generated unless the amount of fountain solution is increased at the time of printing. Thus, a so-called water allowance is narrowed.

Various studies have been made to obtain lithographic printing plate supports exhibiting good properties. For example, Patent Literature 1 discloses a method of manufacturing a lithographic printing plate support which includes a first step for anodizing a roughened aluminum plate surface and a second step for reanodizing under such conditions that the diameter of micropores may be smaller than that in the anodized film formed in the first step. It is described that the lithographic printing plate obtained using the lithographic printing plate support does not deteriorate the deinking ability in continued printing, improves the adhesion to the photosensitive layer, does not cause highlight areas to be blown out, and has a long press life.

On the other hand, printing may be suspended. In such a case, the lithographic printing plate is left to stand on the plate cylinder and its non-image areas may be scummed under the influence of the contamination in the atmosphere. Therefore, when the printing having been suspended is resumed, a number of sheets must be printed until normal printing can be made, thus causing wasted use of printing paper or other defect. It is known that these defects prominently occur in the lithographic printing plates having undergone electrochemical graining treatment in an acidic solution containing hydrochloric acid. In the following description, the number of sheets wasted when the printing having been suspended is resumed is used to evaluate the deinking ability after suspended printing and the deinking ability after suspended printing is rated "good" when the number of wasted sheets is small.

In addition, a large number of researches have been made on computer-to-plate (CTP) systems which are under remarkable progress in recent years. In particular, a presensitized plate which can be mounted for printing on a printing press without being developed after exposure to light has been required to solve the problem of wastewater treatment while further rationalizing the process.

One of the methods for eliminating a treatment step is a method called "on-press development" in which an exposed presensitized plate is mounted on a plate cylinder of a printing press and fountain solution and ink are supplied as the plate cylinder is rotated to thereby remove non-image areas of the presensitized plate. In other words, this is a system in which the exposed presensitized plate is mounted on the printing press without any further treatment so that development completes in the usual printing process. The presensitized plate suitable for use in such on-press development is required to have an image recording layer which is soluble in fountain solution or an ink solvent and to have a light-room handling property suitable to the development on a printing press placed in a light room. In the following description, the number of sheets of printed paper required to reach the state in which no ink is transferred to non-image areas after the completion of the on-press development of the unexposed areas is used to evaluate the on-press developability, which is rated "good" when the number of wasted sheets is small.

CITATION LIST

Patent Literature

Patent Literature 1: JP 11-291657 A

SUMMARY OF INVENTION

Technical Problems

The inventors of the invention have made a study on various properties of the lithographic printing plate and the presensitized plate obtained using the lithographic printing plate support specifically described in Patent Literature 1 and as a result found that the press life has a trade-off relation with the deinking ability after suspended printing or the on-press developability and these properties cannot be simultaneously achieved, and this is not necessarily satisfactory in practical use. In addition, it has been found that the scratch resistance of the lithographic printing plate support is also to be improved.

In view of the situation as described above, an object of the invention is to provide a lithographic printing plate support that has excellent scratch resistance and is capable of obtaining a presensitized plate which exhibits excellent on-press developability and enables a lithographic printing plate formed therefrom to have a long press life and excellent deinking ability after suspended printing. Another object of the invention is to provide a method of manufacturing such a lithographic printing plate support. Still another object of the invention is to provide a presensitized plate.

Solution to Problems

The inventors of the invention have made an intensive study to achieve the objects and as a result found that the foregoing problems can be solved by controlling the shape of micropores in the anodized film.

Specifically, the invention provides the following (1) to (10).

(1) A lithographic printing plate support comprising: an aluminum plate; and an aluminum anodized film formed on the aluminum plate and having micropores which extend in a depth direction of the anodized film from a surface of the anodized film opposite from the aluminum plate, wherein each of the micropores has a large-diameter portion which extends to a depth of 5 to 60 nm (depth A) from the surface of the anodized film and a small-diameter portion which communicates with a bottom of the large-diameter portion and extends to a depth of 900 to 2,000 nm from a communication position, wherein an average diameter of the large-diameter portion at the surface of the anodized film is from 10 to 60 nm and a ratio of the depth A to the average diameter (depth A/average diameter) is from 0.1 to 4.0, wherein a communication position average diameter of the small-diameter portion is more than 0 but less than 20 nm, and wherein a ratio of the average diameter of the small-diameter portion to the average diameter of the large-diameter portion (small-diameter portion diameter/large-diameter portion diameter) is up to 0.85.

(2) The lithographic printing plate support according to (1), wherein the average diameter of the large-diameter portion is from 10 to 50 nm.

(3) The lithographic printing plate support according to (1) or (2), wherein the depth A is from 10 to 50 nm.

(4) The lithographic printing plate support according to any one of (1) to (3), wherein the ratio of the depth A to the average diameter is at least 0.30 but less than 3.0.

(5) The lithographic printing plate support according to any one of (1) to (4), wherein the micropores are formed at a density of 100 to 3,000 pcs/$\mu m^2$.

(6) A lithographic printing plate support-manufacturing method for manufacturing the lithographic printing plate support according to any one of (1) to (5), comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

(7) The lithographic printing plate support-manufacturing method according to (6), wherein a ratio between a thickness of the anodized film obtained in the first anodizing treatment step (first film thickness) and a thickness of the anodized film obtained in the second anodizing treatment step (second film thickness) (first film thickness/second film thickness) is from 0.01 to 0.15.

(8) The lithographic printing plate support-manufacturing method according to (6) or (7), wherein the thickness of the anodized film obtained in the second anodizing treatment step is from 900 to 2,000 nm.

(9) A presensitized plate comprising: the lithographic printing plate support according to any one of (1) to (5); and an image recording layer formed thereon.

(10) The presensitized plate according to (9), wherein the image recording layer is one in which an image is formed by exposure to light and unexposed portions are removable with printing ink and/or fountain solution.

Advantageous Effects of Invention

The invention can provide a lithographic printing plate support that has excellent scratch resistance and enables a lithographic printing plate obtained therefrom to have a long press life and excellent deinking ability after suspended printing, a manufacturing method thereof, and a presensitized plate obtained using the support.

In the on-press development type lithographic printing plate, the press life can be improved while keeping the on-press developability.

DESCRIPTION OF EMBODIMENTS

The lithographic printing plate support and its manufacturing method according to the invention are described below.

The lithographic printing plate support according to the invention includes an aluminum plate and an anodized film formed thereon, each of micropores in the anodized film being of such a shape that a large-diameter portion having a larger average diameter communicates with a small-diameter portion having a smaller average diameter along the depth direction (i.e., the thickness direction of the film). Particularly in the invention, although the press life has been deemed to have a trade-off relation with the deinking ability after suspended printing or the on-press developability, these properties can be simultaneously achieved at a higher level by controlling the depth of the large-diameter portions having a larger average diameter in the micropores.

Figure 1:
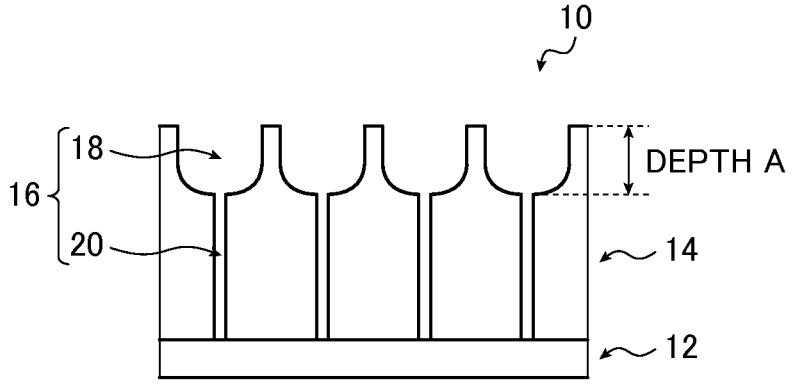
FIG. 1 is a schematic cross-sectional view showing an embodiment of a lithographic printing plate support of the invention.

FIG. 1 is a schematic cross-sectional view showing an embodiment of the lithographic printing plate support of the invention.

A lithographic printing plate support 10 shown in FIG. 1 is of a laminated structure in which an aluminum plate 12 and an anodized aluminum film 14 are stacked in this order. The anodized film 14 has micropores 16 extending from its surface toward the aluminum plate 12 side, and each micropore 16 has a large-diameter portion 18 and a small-diameter portion 20.

The aluminum plate 12 and the anodized film 14 are first described in detail.

[Aluminum Plate]

The aluminum plate 12 (aluminum support) used in the invention is made of a dimensionally stable metal composed primarily of aluminum; that is, aluminum or aluminum alloy. The aluminum plate is selected from among plates of pure aluminum, alloy plates composed primarily of aluminum and containing small amounts of other elements, and plastic films or paper on which aluminum (alloy) is laminated or vapor-deposited. In addition, a composite sheet as described in JP 48-18327 B in which an aluminum sheet is attached to a polyethylene terephthalate film may be used.

In the following description, the above-described plates made of aluminum or aluminum alloys are referred to collectively as "aluminum plate 12." Other elements which may be present in the aluminum alloy include silicon, iron, manganese, copper, magnesium, chromium, zinc, bismuth, nickel and titanium. The content of other elements in the alloy is not more than 10 wt %. In the invention, the aluminum plate used is preferably made of pure aluminum but may contain small amounts of other elements because it is difficult to manufacture completely pure aluminum from the viewpoint of smelting technology. The aluminum plate 12 which is applied to the invention as described above is not specified for its composition but conventionally known materials such as JIS A1050, JIS A1100, JIS A3103 and JIS A3005 materials can be appropriately used.

The aluminum plate 12 used in the invention is treated as it continuously travels usually in a web form, and has a width of about 400 mm to about 2,000 mm and a thickness of about 0.1 mm to about 0.6 mm. The width and thickness may be changed as appropriate based on such considerations as the size of the printing press, the size of the printing plate and the desires of the user.

The aluminum plate is appropriately subjected to substrate surface treatments to be described later.

[Anodized Film]

The anodized film 14 refers to an anodized aluminum film that is generally formed at a surface of the aluminum plate 12 by anodizing treatment and has the micropores 16 which are vertical to the film surface and are individually distributed in a uniform manner. The micropores 16 extend along the thickness direction of the anodized film from the surface of the anodized film opposite to the aluminum plate 12 toward the aluminum plate 12 side.

Each micropore 16 in the anodized film 14 has the large-diameter portion 18 which extends to a depth of 5 to 60 nm from the anodized film surface (depth A: see FIG. 1), and the small-diameter portion 20 which communicates with the bottom of the large-diameter portion 18 and further extends to a depth of 900 to 2,000 nm from the communication position.

The large-diameter portion 18 and the small-diameter portion 20 are described below in detail.

(Large-Diameter Portion)

The large-diameter portions 18 have an average diameter (average aperture size) of 10 to 60 nm at the surface of the anodized film. At an average diameter within the foregoing range, the lithographic printing plate obtained using the lithographic printing plate support has a long press life and excellent deinking ability after suspended printing, and the presensitized plate obtained using the support has excellent on-press developability. In terms of longer press life of the lithographic printing plate obtained using the lithographic printing plate support, the average diameter is preferably from 10 to 50 nm, more preferably from 15 to 50 nm and even more preferably from 20 to 50 nm.

At an average diameter of less than 10 nm, a sufficient anchor effect is not obtained, nor is the press life of the lithographic printing plate improved. At an average diameter in excess of 60 nm, the roughened surface is damaged whereby the properties such as press life and deinking ability after suspended printing cannot be improved.

The average diameter of the large-diameter portions 18 is determined as follows: The surface of the anodized film 14 is taken by FE-SEM at a magnification of 150,000× to obtain four images, and in the resulting four images, the diameter of the micropores (large-diameter portions) within an area of 400×600 $nm^2$ is measured and the average of the measurements is calculated.

The equivalent circle diameter is used if the large-diameter portion 18 does not have a circular cross-sectional shape. The "equivalent circle diameter" refers to a diameter of a circle assuming that the shape of an aperture is the circle having the same projected area as that of the aperture.

The bottom of each large-diameter portion 18 is at a depth of 5 to 60 nm from the surface of the anodized film (hereinafter this depth is also referred to as "depth A"). In other words, each large-diameter portion 18 is a pore portion which extends from the surface of the anodized film in the depth direction (thickness direction) to a depth of 5 to 60 nm. The depth is preferably from 10 nm to 50 nm from the viewpoint that the lithographic printing plate obtained using the lithographic printing plate support has a longer press life and more excellent deinking ability after suspended printing and the presensitized plate obtained using the support has more excellent on-press developability.

At a depth of less than 5 nm, a sufficient anchor effect is not obtained, nor is the press life of the lithographic printing plate improved. At a depth in excess of 60 nm, the lithographic printing plate has poor deinking ability after suspended printing and the presensitized plate has poor on-press developability.

The depth is determined by taking a cross-sectional image of the anodized film 14 at a magnification of 150,000×, measuring the depth of at least 25 large-diameter portions, and calculating the average of the measurements.

The ratio of the depth A of the large-diameter portions 18 to their bottoms to the average diameter of the large-diameter portions 18 (depth A/average diameter) is from 0.1 to 4.0. The ratio of the depth A to the average diameter is preferably at least 0.3 but less than 3.0, and more preferably at least 0.3 but less than 2.5 from the viewpoint that the lithographic printing plate obtained using the lithographic printing plate support has a longer press life and more excellent deinking ability after suspended printing and that the presensitized plate obtained using the support has more excellent on-press developability.

At a ratio of the depth A to the average diameter of less than 0.1, the press life of the lithographic printing plate is not improved. At a ratio of the depth A to the average diameter in excess of 4.0, the lithographic printing plate has poor deinking ability after suspended printing and the presensitized plate has poor on-press developability.

The shape of the large-diameter portions 18 is not particularly limited. Exemplary shapes include a substantially straight tubular shape (substantially columnar shape), and a conical shape in which the diameter decreases in the depth direction (thickness direction), and a substantially straight tubular shape is preferred. The bottom shape of the large-diameter portions 18 is not particularly limited and may be curved (convex) or flat.

The internal diameter of the large-diameter portions 18 is not particularly limited and is usually substantially equal to or smaller than the diameter of the apertures. There may be usually a difference of about 1 nm to about 10 nm between the internal diameter of the large-diameter portions 18 and the aperture diameter of the large-diameter portions 18.

(Small-Diameter Portion)

As shown in FIG. 1, each of the small-diameter portions 20 is a pore portion which communicates with the bottom of the corresponding large-diameter portion 18 and further extends from the communication position in the depth direction (i.e., in the thickness direction). One small-diameter portion 20 usually communicates with one large-diameter portion 18 but two or more small-diameter portions 20 may communicate with the bottom of one large-diameter portion 18.

The small-diameter portions 20 have a communication position average diameter of more than 0 but less than 20 nm. The communication position average diameter is preferably up to 15 nm, more preferably up to 13 nm and most preferably from 5 to 10 nm in terms of the deinking ability after suspended printing and on-press developability.

At an average diameter of 20 nm or more, the lithographic printing plate obtained using the lithographic printing plate support of the invention has poor deinking ability after suspended printing and the presensitized plate has poor on-press developability.

The average diameter of the small-diameter portions 20 is determined as follows: The surface of the anodized film 14 is taken by FE-SEM at a magnification of 150,000× to obtain four images, and in the resulting four images, the diameter of the micropores (small-diameter portions) within an area of 400×600 $nm^2$ is measured and the average of the measurements is calculated. When the depth of the large-diameter portions is large, the average diameter of the small-diameter portions may be determined by optionally cutting out the upper region of the anodized film 14 including the large-diameter portions by argon gas and observing the surface of the anodized film 14 by FE-SEM.

The equivalent circle diameter is used if the small-diameter portion 20 does not have a circular cross-sectional shape. The "equivalent circle diameter" refers to a diameter of a circle assuming that the shape of an aperture is the circle having the same projected area as that of the aperture.

The bottom of each small-diameter portion 20 is at a distance of 900 to 2,000 nm in the depth direction from the communication position with the corresponding large-diameter portion 18 which has the depth A up to the communication position. In other words, the small-diameter portions 20 are pore portions each of which further extends in the depth direction (thickness direction) from the communication position with the corresponding large-diameter portion 18 and the small-diameter portions 20 have a length of 900 to 2,000 nm. The bottom of each small-diameter portion 20 is preferably at a depth of 900 to 1,500 nm from the communication position in terms of the scratch resistance of the lithographic printing plate support.

At a depth of less than 900 nm, the lithographic printing plate support has poor scratch resistance. A depth in excess of 2,000 nm requires a prolonged treatment time and reduces the productivity and economic efficiency.

The depth is determined by taking a cross-sectional image of the anodized film 14 at a magnification of 50,000×, measuring the depth of at least 25 small-diameter portions, and calculating the average of the measurements.

The ratio of the communication position average diameter of the small-diameter portions 20 to the average diameter of the large-diameter portions 18 at the surface of the anodized film (small-diameter portion diameter/large-diameter portion diameter) is up to 0.85. The lower limit of the ratio is more than 0, and the ratio is preferably from 0.02 to 0.85 and more preferably from 0.1 to 0.70. At an average diameter ratio within the foregoing range, the lithographic printing plate has a longer press life and more excellent deinking ability after suspended printing and the presensitized plate has more excellent on-press developability.

At an average diameter ratio in excess of 0.85, a good balance cannot be struck between the press life and the deinking ability after suspended printing/on-press developability.

The shape of the small-diameter portions 20 is not particularly limited. Exemplary shapes include a substantially straight tubular shape (substantially columnar shape), and a conical shape in which the diameter decreases in the depth direction, and a substantially straight tubular shape is preferred. The bottom shape of the small-diameter portions 20 is not particularly limited and may be curved (convex) or flat.

The internal diameter of the small-diameter portions 20 is not particularly limited and may be usually substantially equal to, or smaller or larger than the communication position diameter. There may be usually a difference of about 1 nm to about 10 nm between the internal diameter of the small-diameter portions 20 and the aperture diameter of the small-diameter portions 20.

The density of the micropores 16 in the anodized film 14 is not particularly limited and the anodized film 14 preferably has 50 to 4,000 micropores/$\mu m^2$, and more preferably 100 to 3,000 micropores/$\mu m^2$ because the resulting lithographic printing plate has a long press life and excellent deinking ability after suspended printing and the presensitized plate has excellent on-press developability.

The coating weight of the anodized film 14 is not particularly limited and is preferably from 2.3 to 5.5 $g/m^2$ and more preferably from 2.3 to 4.0 $g/m^2$ in terms of excellent scratch resistance of the lithographic printing plate support.

The above-described lithographic printing plate support having an image recording layer to be described later formed on a surface thereof can be used as a presensitized plate.

[Method of Manufacturing Lithographic Printing Plate Support]

The method of manufacturing the lithographic printing plate support according to the invention is described below.

The method of manufacturing the lithographic printing plate support according to the invention is not particularly limited and a manufacturing method in which the following steps are performed in order is preferred.

(Surface roughening treatment step) Step of surface roughening treatment on an aluminum plate;

(First anodizing treatment step) Step of anodizing the aluminum plate having undergone surface roughening treatment;

(Pore-widening treatment step) Step of increasing the diameter of micropores in an anodized film by bringing the aluminum plate having the anodized film obtained in the first anodizing treatment step into contact with an aqueous acid or alkali solution;

(Second anodizing treatment step) Step of anodizing the aluminum plate obtained in the pore-widening treatment step;

(Hydrophilizing treatment step) Step of hydrophilizing the aluminum plate obtained in the second anodizing treatment step.

The respective steps are described below in detail. The surface roughening treatment step and the hydrophilizing treatment step may not be performed if they are not effective to the invention. FIG. 2 is a schematic cross-sectional view showing the substrate and the anodized film in order of steps from the first anodizing treatment step to the second anodizing treatment step.

[Surface Roughening Treatment Step]

The surface roughening treatment step is a step in which the surface of the aluminum plate is subjected to surface roughening treatment including electrochemical graining treatment. This step is preferably performed before the first anodizing treatment step to be described later but may not be performed if the aluminum plate already has a preferred surface shape.

The surface roughening treatment may include solely electrochemical graining treatment, or electrochemical graining treatment, mechanical graining treatment and/or chemical graining treatment in combination.

In cases where mechanical graining treatment is combined with electrochemical graining treatment, mechanical graining treatment is preferably followed by electrochemical graining treatment.

In the practice of the invention, electrochemical graining treatment is preferably carried out in an aqueous solution of nitric acid or hydrochloric acid.

Mechanical graining treatment is generally performed in order that the surface of the aluminum plate may have a surface roughness $R_a$ of 0.35 to 1.0 μm.

In the invention, mechanical graining treatment is not particularly limited for its conditions and can be performed according to the method described in, for example, JP 50-40047 B. Mechanical graining treatment can be carried out by brush graining using a suspension of pumice or a transfer system.

Chemical graining treatment is also not particularly limited but may be carried out by any known method.

Mechanical graining treatment is preferably followed by chemical etching treatment described below.

The purpose of chemical etching treatment following mechanical graining treatment is to smooth edges of irregularities at the surface of the aluminum plate to prevent ink from catching on the edges during printing, to improve the scumming resistance of the lithographic printing plate, and to remove abrasive particles or other unnecessary substances remaining on the surface.

Chemical etching processes including etching using an acid and etching using an alkali are known in the art, and an exemplary method which is particularly excellent in terms of etching efficiency includes chemical etching treatment using an alkali solution. This treatment is hereinafter referred to as "alkali etching treatment."

Alkaline agents that may be used in the alkali solution are not particularly limited and illustrative examples of suitable alkaline agents include sodium hydroxide, potassium hydroxide, sodium metasilicate, sodium carbonate, sodium aluminate, and sodium gluconate.

The alkaline agents may contain aluminum ions. The alkali solution has a concentration of preferably at least 0.01 wt % and more preferably at least 3 wt %, but preferably not more than 30 wt % and more preferably not more than 25 wt %.

The alkali solution has a temperature of preferably room temperature or higher, and more preferably at least 30° C., but preferably not more than 80° C., and more preferably not more than 75° C.

The amount of material removed from the aluminum plate (also referred to below as the "etching amount") is preferably at least 0.1 g/m$^2$ and more preferably at least 1 g/m$^2$, but preferably not more than 20 g/m$^2$ and more preferably not more than 10 g/m$^2$.

The treatment time is preferably from 2 seconds to 5 minutes depending on the etching amount and more preferably from 2 to 10 seconds in terms of improving the productivity.

In cases where mechanical graining treatment is followed by alkali etching treatment in the invention, chemical etching treatment using an acid solution at a low temperature (hereinafter also referred to as "desmutting treatment") is preferably performed to remove substances produced by alkali etching treatment.

Acids that may be used in the acid solution are not particularly limited and illustrative examples thereof include sulfuric acid, nitric acid and hydrochloric acid. The acid solution preferably has a concentration of 1 to 50 wt %. The acid solution preferably has a temperature of 20 to 80° C. When the concentration and temperature of the acid solution fall within the above-defined ranges, a lithographic printing plate obtained by using the inventive lithographic printing plate support has a more improved resistance to spotting.

In the practice of the invention, the surface roughening treatment is a treatment in which electrochemical graining treatment is carried out after mechanical graining treatment and chemical etching treatment are carried out as desired, but also in cases where electrochemical graining treatment is carried out without performing mechanical graining treatment, electrochemical graining treatment may be preceded by chemical etching treatment using an aqueous alkali solution such as sodium hydroxide. In this way, impurities which are present in the vicinity of the surface of the aluminum plate can be removed.

Electrochemical graining treatment easily forms fine pits at the surface of the aluminum plate and is therefore suitable to prepare a lithographic printing plate having excellent printability.

Electrochemical graining treatment is carried out in an aqueous solution containing nitric acid or hydrochloric acid as its main ingredient using direct or alternating current.

Electrochemical graining treatment is preferably followed by chemical etching treatment described below. Smut and intermetallic compounds are present at the surface of the aluminum plate having undergone electrochemical graining treatment. In chemical etching treatment following electrochemical graining treatment, it is preferable for chemical etching using an alkali solution (alkali etching treatment) to be first carried out in order to particularly remove smut with high efficiency. The conditions in chemical etching using an alkali solution preferably include a treatment temperature of 20 to 80° C. and a treatment time of 1 to 60 seconds. It is desirable for the alkali solution to contain aluminum ions.

In order to remove substances generated by chemical etching treatment using an alkali solution following electrochemical graining treatment, it is further preferable to carry out chemical etching treatment using an acid solution at a low temperature (desmutting treatment).

Even in cases where electrochemical graining treatment is not followed by alkali etching treatment, desmutting treatment is preferably carried out to remove smut efficiently.

In the practice of the invention, chemical etching treatment is not particularly limited and may be carried out by immersion, showering, coating or other process.

[First Anodizing Treatment Step]

Figure 2A:
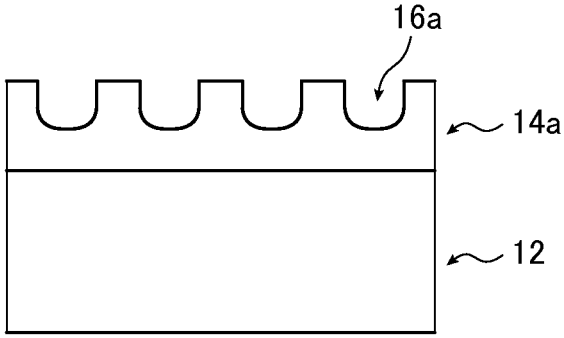
FIG. 2 is a schematic cross-sectional view showing a substrate and an anodized film in the order of steps in a method of manufacturing the lithographic printing plate support of the invention.

The first anodizing treatment step is a step in which an anodized aluminum film having micropores which extend in the depth direction (thickness direction) of the film is formed at the surface of the aluminum plate by performing anodizing treatment on the aluminum plate having undergone the above-described surface roughening treatment. As shown in FIG. 2A, as a result of the first anodizing treatment step, an anodized aluminum film 14*a* bearing micropores 16*a* is formed at a surface of the aluminum substrate 12.

The first anodizing treatment may be performed by a conventionally known method in the art but the manufacturing conditions are appropriately set so that the foregoing micropores 16 may be finally formed.

More specifically, the average diameter (average aperture size) of the micropores 16*a* formed in the first anodizing treatment step is typically from about 4 nm to about 14 nm and preferably 5 to 10 nm. At an average aperture size within the foregoing range, the micropores 16 having the foregoing specified shapes are easily formed and the resulting lithographic printing plate and presensitized plate have more excellent properties.

The micropores 16*a* usually have a depth of about 10 nm or more but less than about 100 nm, and preferably 20 to 60 nm. At an average aperture size within the foregoing range, the micropores 16 having the foregoing specified shapes are easily formed and the resulting lithographic printing plate and presensitized plate have more excellent properties.

The density of the micropores 16*a* is not particularly limited and is preferably 50 to 4,000 pcs/$\mu m^2$, and more preferably 100 to 3,000 pcs/$\mu m^2$. At a micropore density within the foregoing range, the lithographic printing plate obtained has a long press life and excellent deinking ability after suspended printing and the presensitized plate has excellent on-press developability.

The anodized film obtained by the first anodizing treatment step preferably has a thickness of 35 to 120 nm and more preferably 40 to 90 nm. At a film thickness within the foregoing range, the lithographic printing plate using the lithographic printing plate support obtained after the foregoing steps has a long press life and excellent deinking ability after suspended printing, and the presensitized plate has excellent on-press developability.

In addition, the anodized film obtained by the first anodizing treatment step preferably has a coating weight of 0.1 to 0.3 g/$m^2$ and more preferably 0.12 to 0.25 g/$m^2$. At a coating weight within the foregoing range, the lithographic printing plate using the lithographic printing plate support obtained after the foregoing steps has a long press life and excellent deinking ability after suspended printing, and the presensitized plate has excellent on-press developability.

In the first anodizing treatment step, aqueous solutions of acids such as sulfuric acid, phosphoric acid and oxalic acid may be mainly used for the electrolytic cell. An aqueous solution or non-aqueous solution containing chromic acid, sulfamic acid, benzenesulfonic acid or a combination of two or more thereof may optionally be used. The anodized film can be formed at the surface of the aluminum plate by passing direct current or alternating current through the aluminum plate in the foregoing electrolytic cell.

The electrolytic cell may contain aluminum ions. The content of the aluminum ions is not particularly limited and is preferably from 1 to 10 g/L.

The anodizing treatment conditions are appropriately set depending on the electrolytic solution employed. However, the following conditions are generally suitable: an electrolyte concentration of from 1 to 80 wt %, a solution temperature of from 5 to 70° C., a current density of from 0.5 to 60 A/$dm^2$, a voltage of from 1 to 100 V, and an electrolysis time of from 1 to 100 seconds. An electrolyte concentration of from 5 to 20 wt %, a solution temperature of from 10 to 60° C., a current density of from 5 to 50 A/$dm^2$, a voltage of from 5 to 50 V, and an electrolysis time of from 5 to 60 seconds are preferred.

Of these anodizing treatment methods, the method described in GB 1,412,768 which involves anodizing in sulfuric acid at a high current density is preferred.

[Pore-Widening Treatment Step]

Figure 2B:
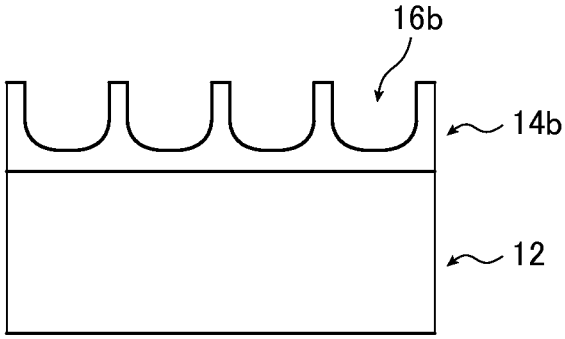

The pore-widening treatment step is a step for increasing the diameter (pore size) of the micropores present in the anodized film formed by the above-described first anodizing treatment step (pore size-increasing treatment). As shown in FIG. 2B, the pore-widening treatment increases the diameter of the micropores 16*a* to form an anodized film 14*b* having micropores 16*b* with a larger average diameter.

The pore-widening treatment increases the average diameter of the micropores 16*b* to a range of 10 nm to 60 nm and preferably 10 nm to 50 nm. The micropores 16*b* correspond to the above-described large-diameter portions 18.

The depth of the micropores 16*b* from the film surface is preferably adjusted by this treatment so as to be approximately the same as the depth A.

Pore-widening treatment is performed by contacting the aluminum plate obtained by the above-described first anodizing treatment step with an aqueous acid or alkali solution. Examples of the contacting method include, but are not limited to, immersion and spraying. Of these, immersion is preferred.

When the pore-widening treatment step is to be performed with an aqueous alkali solution, it is preferable to use an aqueous solution of at least one alkali selected from the group consisting of sodium hydroxide, potassium hydroxide and lithium hydroxide. The aqueous alkali solution preferably has a concentration of 0.1 to 5 wt %.

The aluminum plate is suitably contacted with the aqueous alkali solution at 10° C. to 70° C. and preferably 20° C. to 50° C. for 1 to 300 seconds and preferably 1 to 50 seconds after the aqueous alkali solution is adjusted to a pH of 11 to 13.

The alkaline treatment solution may contain metal salts of polyvalent weak acids such as carbonates, borates and phosphates.

When the pore-widening treatment step is to be performed with an aqueous acid solution, it is preferable to use an aqueous solution of an inorganic acid such as sulfuric acid, phosphoric acid, nitric acid or hydrochloric acid, or a mixture thereof. The aqueous acid solution preferably has a concentration of 1 to 80 wt % and more preferably 5 to 50 wt %.

The aluminum plate is suitably contacted with the aqueous acid solution at 5° C. to 70° C. and preferably 10° C. to 60° C. for 1 to 300 seconds and preferably 1 to 150 seconds.

The aqueous alkali or acid solution may contain aluminum ions. The content of the aluminum ions is not particularly limited and is preferably from 1 to 10 g/L.

[Second Anodizing Treatment Step]

Figure 2C:
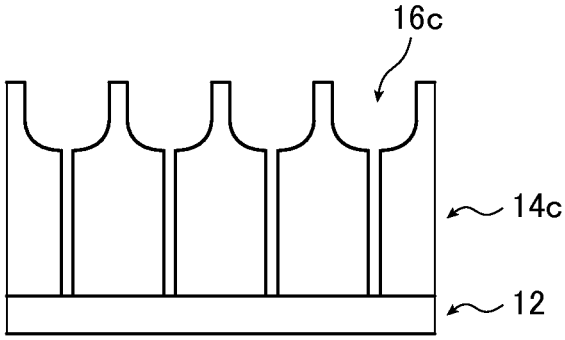

The second anodizing treatment step is a step in which micropores which further extend in the depth direction (thickness direction) of the film are formed by performing anodizing treatment on the aluminum plate having undergone the above-described pore-widening treatment. As shown in FIG. 2C, an anodized film 14*c* bearing micropores 16*c* which extend in the depth direction of the film is formed by the second anodizing treatment step.

The second anodizing treatment step forms new pores which communicate with the bottoms of the micropores 16*b* with the increased average diameter, have a smaller average diameter than that of the micropores 16*b* corresponding to the large-diameter portions 18 and extend from the communication positions in the depth direction. The pores correspond to the above-described small-diameter portions 20.

In the second anodizing treatment step, the treatment is performed so that the newly formed pores have an average diameter of more than 0 but less than 20 nm and a depth from the communication positions with the large-diameter portions 20 within the foregoing specified range. The electrolytic cell used for the treatment is the same as used in the first anodizing treatment step and the treatment conditions are set as appropriate for the materials used.

The anodizing treatment conditions are appropriately set depending on the electrolytic solution employed. However, the following conditions are generally suitable: an electrolyte concentration of from 1 to 80 wt %, a solution temperature of from 5 to 70° C., a current density of from 0.5 to 60 A/dm$^2$, a voltage of from 1 to 100 V, and an electrolysis time of from 1 to 100 seconds. An electrolyte concentration of from 5 to 20 wt %, a solution temperature of from 10 to 60° C., a current density of from 1 to 30 A/dm$^2$, a voltage of from 5 to 50 V, and an electrolysis time of from 5 to 60 seconds are preferred.

The anodized film obtained by the second anodizing treatment step usually has a thickness of 900 to 2,000 nm and preferably 900 to 1,500 nm. At a film thickness within the foregoing range, the lithographic printing plate using the lithographic printing plate support obtained after the foregoing steps has a long press life and excellent deinking ability after suspended printing, and the presensitized plate has excellent on-press developability.

The anodized film obtained by the second anodizing treatment step usually has a coating weight of 2.2 to 5.4 g/m$^2$ and preferably 2.2 to 4.0 g/m$^2$. At a coating weight within the foregoing range, the lithographic printing plate using the lithographic printing plate support obtained after the foregoing steps has a long press life and excellent deinking ability after suspended printing, and the presensitized plate has excellent on-press developability.

The ratio between the thickness of the anodized film obtained by the first anodizing treatment step (first film thickness) and that of the anodized film obtained by the second anodizing treatment step (second film thickness) (first film thickness/second film thickness) is preferably from 0.01 to 0.15 and more preferably from 0.02 to 0.10. At a film thickness ratio within the foregoing range, the lithographic printing plate support has excellent scratch resistance.

[Hydrophilizing Treatment Step]

The method of manufacturing the lithographic printing plate support according to the invention may have a hydrophilizing treatment step in which the aluminum plate is hydrophilized after the above-described second anodizing treatment step. Hydrophilizing treatment may be performed by any known method disclosed in paragraphs [0109] to [0114] of JP 2005-254638 A.

It is preferable to perform hydrophilizing treatment by a method in which the aluminum plate is immersed in an aqueous solution of an alkali metal silicate such as sodium silicate or potassium silicate, or is coated with a hydrophilic vinyl polymer or a hydrophilic compound so as to form a hydrophilic undercoat.

Hydrophilizing treatment with an aqueous solution of an alkali metal silicate such as sodium silicate or potassium silicate can be carried out according to the processes and procedures described in U.S. Pat. Nos. 2,714,066 and 3,181,461.

On the other hand, the lithographic printing plate support of the invention is preferably one obtained by subjecting the foregoing aluminum plate to the treatments shown in the following Aspect A or B in this order and Aspect A is most preferably used in terms of the press life. Rinsing with water is desirably carried out between the respective treatments. However, in cases where a solution of the same composition is used in the consecutively carried out two steps (treatments), rinsing with water may be omitted.

(Aspect A)

(2) Chemical etching treatment in an aqueous alkali solution (first alkali etching treatment);

(3) Chemical etching treatment in an aqueous acid solution (first desmutting treatment);

(4) Electrochemical graining treatment in a nitric acid-based aqueous solution (first electrochemical graining treatment);

(5) Chemical etching treatment in an aqueous alkali solution (second alkali etching treatment);

(6) Chemical etching treatment in an aqueous acid solution (second desmutting treatment);

(7) Electrochemical graining treatment in a hydrochloric acid-based aqueous solution (second electrochemical graining treatment);

(8) Chemical etching treatment in an aqueous alkali solution (third alkali etching treatment);

(9) Chemical etching treatment in an aqueous acid solution (third desmutting treatment);

(10) Anodizing treatments (first anodizing treatment and second anodizing treatment)

(11) Hydrophilizing treatment.

(Aspect B)

(2) Chemical etching treatment in an aqueous alkali solution (first alkali etching treatment);

(3) Chemical etching treatment in an aqueous acid solution (first desmutting treatment);

(12) Electrochemical graining treatment in a hydrochloric acid-based aqueous solution;

(5) Chemical etching treatment in an aqueous alkali solution (second alkali etching treatment);

(6) Chemical etching treatment in an aqueous acid solution (second desmutting treatment);

(10) Anodizing treatments (first anodizing treatment and second anodizing treatment)

(11) Hydrophilizing treatment.

The treatment (2) in Aspects A and B may be optionally preceded by (1) mechanical graining treatment. The treatment (1) is preferably not included in both the aspects in terms of the press life or the like.

Mechanical graining treatment, electrochemical graining treatment, chemical etching treatment, anodizing treatment and hydrophilizing treatment in (1) to (12) described above may be carried out by the same treatment methods and conditions as those described above, but the treatment methods and conditions to be described below are preferably used to carry out such treatments.

Mechanical graining treatment is preferably performed using a rotating nylon brush roll having a bristle diameter of 0.2 to 1.61 mm and a slurry supplied to the surface of the aluminum plate.

Known abrasives may be used and illustrative examples that may be preferably used include silica sand, quartz, aluminum hydroxide and a mixture thereof.

The slurry preferably has a specific gravity of 1.05 to 1.3. Use may be made of a technique that involves spraying of the slurry, a technique that involves the use of a wire brush, or a technique in which the surface shape of a textured mill roll is transferred to the aluminum plate.

The aqueous alkali solution that may be used in chemical etching treatment in the aqueous alkali solution has a concentration of preferably 1 to 30 wt % and may contain aluminum and alloying ingredients present in the aluminum alloy in an amount of 0 to 10 wt %.

An aqueous solution composed mainly of sodium hydroxide is preferably used for the aqueous alkali solution. Chemical etching is preferably carried out at a solution temperature of room temperature to 95° C. for a period of 1 to 120 seconds.

After the end of etching treatment, removal of the treatment solution with nip rollers and rinsing by spraying with water are preferably carried out in order to prevent the treatment solution from being carried into the subsequent step.

In the first alkali etching treatment, the aluminum plate is dissolved in an amount of preferably 0.5 to 30 g/m$^2$, more preferably 1.0 to 20 g/m$^2$, and even more preferably 3.0 to 15 g/m$^2$.

In the second alkali etching treatment, the aluminum plate is dissolved in an amount of preferably 0.001 to 30 g/m$^2$, more preferably 0.1 to 4 g/m$^2$, and even more preferably 0.2 to 1.5 g/m$^2$.

In the third alkali etching treatment, the aluminum plate is dissolved in an amount of preferably 0.001 to 30 g/m$^2$, more preferably 0.01 to 0.8 g/m$^2$, and even more preferably 0.02 to 0.3 g/m$^2$.

In chemical etching treatment in an aqueous acid solution (first to third desmutting treatments), phosphoric acid, nitric acid, sulfuric acid, chromic acid, hydrochloric acid or a mixed acid containing two or more thereof may be advantageously used.

The aqueous acid solution preferably has a concentration of 0.5 to 60 wt %.

Aluminum and alloying ingredients present in the aluminum alloy may dissolve in the aqueous acid solution in an amount of 0 to 5 wt %.

Chemical etching is preferably carried out at a solution temperature of room temperature to 95° C. for a treatment time of 1 to 120 seconds. After the end of desmutting treatment, removal of the treatment solution with nip rollers and rinsing by spraying with water are preferably carried out in order to prevent the treatment solution from being carried into the subsequent step.

The aqueous solution that may be used in electrochemical graining treatment is now described.

An aqueous solution which is used in conventional electrochemical graining treatment involving the use of direct current or alternating current may be employed for the nitric acid-based aqueous solution used in the first electrochemical graining treatment. The aqueous solution to be used may be prepared by adding to an aqueous solution having a nitric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silica may also be dissolved in the nitric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 90° C. and more preferably from 40 to 80° C.

An aqueous solution which is used in conventional electrochemical graining treatment involving the use of direct current or alternating current may be employed for the hydrochloric acid-based aqueous solution used in the second electrochemical graining treatment. The aqueous solution to be used may be prepared by adding to an aqueous solution having a hydrochloric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silica may also be dissolved in the hydrochloric acid-based aqueous solution.

More specifically, use is preferably made of a solution to which aluminum chloride or aluminum nitrate is added so that a 0.5 to 2 wt % aqueous solution of hydrochloric acid may contain 3 to 50 g/L of aluminum ions.

The temperature is preferably from 10 to 60° C. and more preferably from 20 to 50° C. Hypochlorous acid may be added to the aqueous solution.

On the other hand, an aqueous solution which is used in conventional electrochemical graining treatment involving the use of direct current or alternating current may be employed for the hydrochloric acid-based aqueous solution used in electrochemical graining treatment in the aqueous hydrochloric acid solution in Aspect B. The aqueous solution to be used may be prepared by adding 0 to 30 g/L of sulfuric acid to an aqueous solution having a hydrochloric acid concentration of 1 to 100 g/L. The aqueous solution may be prepared by adding to this solution at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silica may also be dissolved in the hydrochloric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 60° C. and more preferably from 20 to 50° C. Hypochlorous acid may be added to the aqueous solution.

A sinusoidal, square, trapezoidal or triangular waveform may be used as the waveform of the alternating current in electrochemical graining treatment. The frequency is preferably from 0.1 to 250 Hz.

Figure 3:
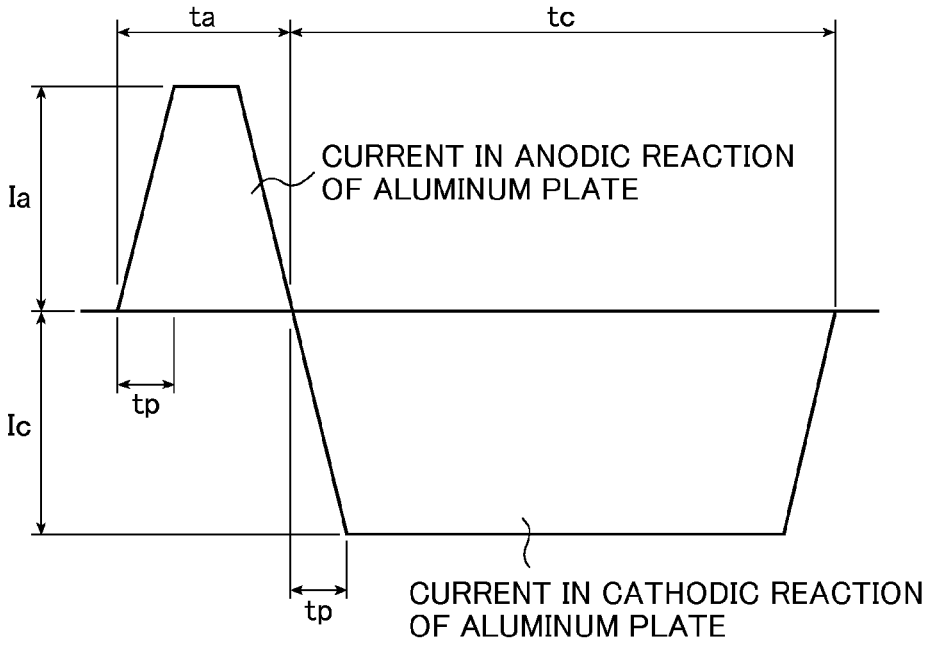
FIG. 3 is a graph showing an example of an alternating current waveform that may be used to carry out electrochemical graining treatment in the method of manufacturing the lithographic printing plate support of the invention.

FIG. 3 is a graph showing an example of an alternating current waveform that may be used to carry out electrochemical graining treatment in the method of manufacturing a lithographic printing plate support of the invention.

In FIG. 3, "ta" represents the anodic reaction time, "tc" the cathodic reaction time, "tp" the time required for the current to reach a peak from zero, "Ia" the peak current on the anode cycle side, and "Ic" the peak current on the cathode cycle side. In the trapezoidal waveform, it is preferable for the time tp until the current reaches a peak from zero to be from 1 to 10 ms. At a time tp of less than 1 ms under the influence of impedance in the power supply circuit, a large power supply voltage is required at the leading edge of the current pulse, thus increasing the power supply equipment costs. At a time tp of more than 10 ms, the aluminum plate tends to be affected by trace ingredients in the electrolytic solution, making it difficult to carry out uniform graining. One cycle of alternating current that may be used in electrochemical graining treatment preferably satisfies the following conditions: the ratio of the cathodic reaction time tc to the anodic reaction time ta in the aluminum plate (tc/ta) is from 1 to 20; the ratio of the amount of electricity Qc when the aluminum plate serves as a cathode to the amount of electricity Qa when it serves as an anode (Qc/Qa) is from 0.3 to 20; and the anodic reaction time ta is from 5 to 1,000 ms. The ratio tc/ta is more preferably from 2.5 to 15. The ratio Qc/Qa is more preferably from 2.5 to 15. The current density at the current peak in the trapezoidal waveform is preferably from 10 to 200 A/dm$^2$ on both of the anode cycle side (Ia) and the cathode cycle side (Ic). The ratio Ic/Ia is preferably in a range of 0.3 to 20. The total amount of electricity furnished for the anodic reaction on the aluminum plate up until completion of electrochemical graining treatment is preferably from 25 to 1,000 C/dm$^2$.

In the practice of the invention, any known electrolytic cell employed for surface treatment, including vertical, flat and radial type electrolytic cells, may be used to perform electrochemical graining treatment using alternating current. A radial type electrolytic cell such as the one described in JP 5-195300 A is especially preferred.

Figure 4:
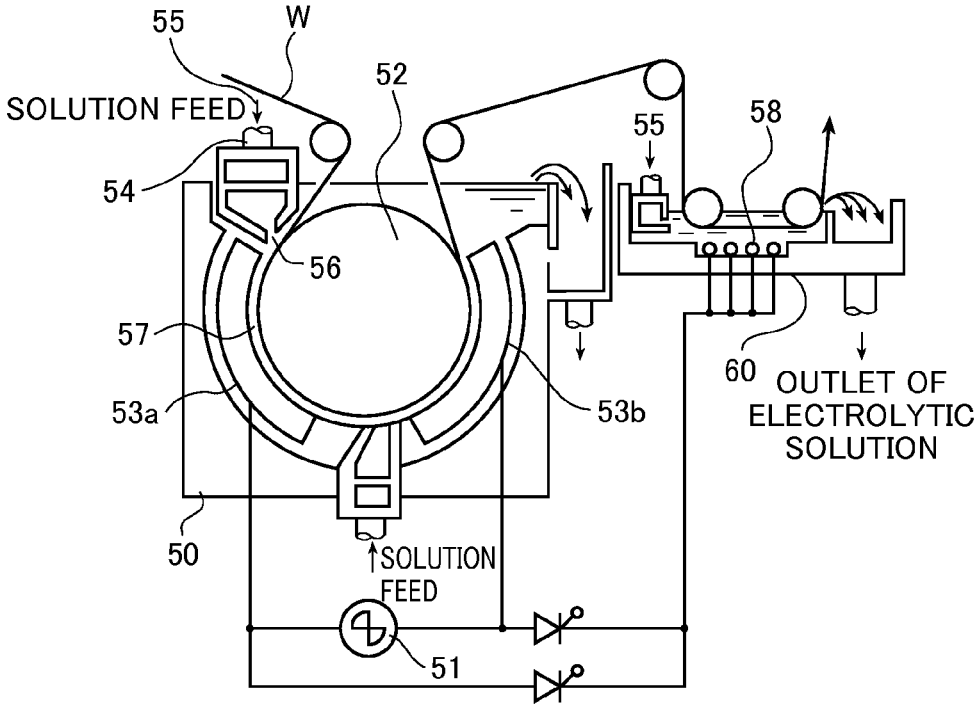
FIG. 4 is a side view of a radial cell that may be used in electrochemical graining treatment with alternating current in the method of manufacturing the lithographic printing plate support of the invention.

An apparatus shown in FIG. 4 may be used for electrochemical graining treatment using alternating current.

FIG. 4 is a side view of a radial cell that may be used in electrochemical graining treatment with alternating current in the method of manufacturing the lithographic printing plate support of the invention.

FIG. 4 shows a main electrolytic cell 50, an AC power supply 51, a radial drum roller 52, main electrodes 53*a* and 53*b*, a solution feed inlet 54, an electrolytic solution 55, a slit 56, an electrolytic solution channel 57, an auxiliary anode 58, an auxiliary anode cell 60 and an aluminum plate W. When two or more electrolytic cells are used, electrolysis may be performed under the same or different conditions.

The aluminum plate W is wound around the radial drum roller 52 disposed so as to be immersed in the main electrolytic cell 50 and is electrolyzed by the main electrodes 53*a* and 53*b* connected to the AC power supply 51 as it travels. The electrolytic solution 55 is fed from the solution feed inlet 54 through the slit 56 to the electrolytic solution channel 57 between the radial drum roller 52 and the main electrodes 53*a* and 53*b*. The aluminum plate W treated in the main electrolytic cell 50 is then electrolyzed in the auxiliary anode cell 60. In the auxiliary anode cell 60, the auxiliary anode 58 is disposed in a face-to-face relationship with the aluminum plate W so that the electrolytic solution 55 flows through the space between the auxiliary anode 58 and the aluminum plate W.

On the other hand, electrochemical graining treatments (first and second electrochemical graining treatments) may be performed by a method in which the aluminum plate is electrochemically grained by applying direct current between the aluminum plate and the electrodes opposed thereto.

<Drying Step>

After the lithographic printing plate support is obtained by the above-described steps, a treatment for drying the surface of the lithographic printing plate support (drying step) is preferably performed before providing an image recording layer to be described later thereon.

Drying is preferably performed after the support having undergone the last surface treatment is rinsed with water and the water removed with nip rollers. Specific conditions are not particularly limited but the surface of the lithographic printing plate support is preferably dried by hot air at 50° C. to 200° C. or natural air.

[Presensitized Plate]

The presensitized plate of the invention can be obtained by forming an image recording layer such as a photosensitive layer or a thermosensitive layer to be illustrated below on the lithographic printing plate support of the invention. The type of the image recording layer is not particularly limited but conventional positive type, conventional negative type, photopolymer type, thermal positive type, thermal negative type and on-press developable non-treatment type as described in paragraphs [0042] to [0198] of JP 2003-1956 A are preferably used.

A preferred image recording layer is described below in detail.

[Image Recording Layer]

The image recording layer that may be preferably used in the presensitized plate of the invention can be removed by printing ink and/or fountain solution. More specifically, the image recording layer is preferably one which has an infrared absorber, a polymerization initiator and a polymerizable compound and is capable of recording by exposure to infrared light.

In the presensitized plate of the invention, irradiation with infrared light cures exposed portions of the image recording layer to form hydrophobic (lipophilic) regions, while at the start of printing, unexposed portions are promptly removed from the support by fountain solution, ink, or an emulsion of ink and fountain solution.

The constituents of the image recording layer are described below.

(Infrared Absorber)

In cases where an image is formed on the presensitized plate of the invention using a laser emitting infrared light at 760 to 1200 nm as a light source, an infrared absorber is usually used.

The infrared absorber has the function of converting absorbed infrared light into heat and the function of transferring electrons and energy to the polymerization initiator (radical generator) to be described below by excitation with infrared light.

The infrared absorber that may be used in the invention is a dye or pigment having an absorption maximum in a wavelength range of 760 to 1,200 nm.

Dyes which may be used include commercial dyes and known dyes that are mentioned in the technical literature, such as Senryo Binran [Handbook of Dyes] (The Society of Synthetic Organic Chemistry, Japan, 1970).

Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal-thiolate complexes. For example, dyes disclosed in paragraphs [0096] to [0107] of JP 2009-255434 A can be advantageously used.

On the other hand, pigments described, for example, in paragraphs [0108] to [0112] of JP 2009-255434 A may be used.

(Polymerization Initiator)

Exemplary polymerization initiators which may be used are compounds that generate a radical under light or heat energy or both, and initiate or promote the polymerization of a compound having a polymerizable unsaturated group. In the invention, compounds that generate a radical under the action of heat (thermal radical generator) are preferably used.

Known thermal polymerization initiators, compounds having a bond with small bond dissociation energy and photopolymerization initiators may be used as the polymerization initiator.

For example, polymerization initiators described in paragraphs [0115] to [0141] of JP 2009-255434 A may be used.

Onium salts may be used for the polymerization initiator, and oxime ester compounds, diazonium salts, iodonium salts and sulfonium salts are preferred in terms of reactivity and stability.

These polymerization initiators may be added in an amount of 0.1 to 50 wt %, preferably 0.5 to 30 wt % and most preferably 1 to 20 wt % with respect to the total solids making up the image recording layer. An excellent sensitivity and a high resistance to scumming in non-image areas during printing are achieved at a polymerization initiator content within the above-defined range.

(Polymerizable Compound)

Polymerizable compounds are addition polymerizable compounds having at least one ethylenically unsaturated double bond, and are selected from compounds having at least one, and preferably two or more, terminal ethylenically unsaturated bonds. In the invention, use can be made of any addition polymerizable compound known in the prior art, without particular limitation.

For example, polymerizable compounds described in paragraphs to [0163] of JP 2009-255434 A may be used.

Urethane-type addition polymerizable compounds prepared using an addition reaction between an isocyanate group and a hydroxyl group are also suitable. Specific examples include the vinylurethane compounds having two or more polymerizable vinyl groups per molecule that are obtained by adding a hydroxyl group-bearing vinyl monomer of the general formula (A) below to the polyisocyanate compounds having two or more isocyanate groups per molecule mentioned in JP 48-41708 B.

$$CH_2{=}C(R^4)COOCH_2CH(R^5)OH \quad (A)$$

(wherein $R^4$ and $R^5$ are each independently H or $CH_3$.)

The polymerizable compound is used in an amount of preferably 5 to 80 wt %, and more preferably 25 to 75 wt % with respect to the nonvolatile ingredients in the image recording layer. These addition polymerizable compounds may be used singly or in combination of two or more thereof.

(Binder Polymer)

In the practice of the invention, use may be made of a binder polymer in the image recording layer in order to improve the film forming properties of the image recording layer.

Conventionally known binder polymers may be used without any particular limitation and polymers having film forming properties are preferred. Examples of such binder polymers include acrylic resins, polyvinyl acetal resins, polyurethane resins, polyurea resins, polyimide resins, polyamide resins, epoxy resins, methacrylic resins, polystyrene resins, novolac phenolic resins, polyester resins, synthetic rubbers and natural rubbers.

Crosslinkability may be imparted to the binder polymer to enhance the film strength in image areas. To impart crosslinkability to the binder polymer, a crosslinkable functional group such as an ethylenically unsaturated bond may be introduced into the polymer main chain or side chain. The crosslinkable functional groups may be introduced by copolymerization.

Binder polymers disclosed in paragraphs [0165] to [0172] of JP 2009-255434 A may also be used.

The content of the binder polymer is from 5 to 90 wt %, preferably from 5 to 80 wt % and more preferably from 10 to 70 wt % based on the total solids of the image recording layer. A high strength in image areas and good image forming properties are achieved at a binder polymer content within the above-defined range.

The polymerizable compound and the binder polymer are preferably used at a weight ratio of 0.5/1 to 4/1.

(Surfactant)

A surfactant is preferably used in the image recording layer in order to promote the on-press developability at the start of printing and improve the coated surface state.

Exemplary surfactants include nonionic surfactants, anionic surfactants, cationic surfactants, amphoteric surfactants and fluorochemical surfactants.

For example, surfactants disclosed in paragraphs [0175] to [0179] of JP 2009-255434 A may be used.

The surfactants may be used alone or in combination of two or more.

The content of the surfactant is preferably from 0.001 to 10 wt %, and more preferably from 0.01 to 5 wt % with respect to the total solids in the image recording layer.

Various other compounds than those mentioned above may optionally be added to the image recording layer. For example, compounds disclosed in paragraphs [0181] to [0190] of JP 2009-255434 A such as colorants, printing-out agents, polymerization inhibitors, higher fatty acid derivatives, plasticizers, inorganic fine particles and low-molecular-weight hydrophilic compounds may be used.

[Formation of Image Recording Layer]

The image recording layer is formed by dispersing or dissolving the necessary ingredients described above in a solvent to prepare a coating liquid and applying the thus prepared coating liquid to the support. Examples of the solvent that may be used include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate and water.

These solvents may be used alone or as a mixture. The coating liquid has a solids concentration of preferably 1 to 50 wt %.

The image recording layer coating weight (solids content) on the lithographic printing plate support obtained after coating and drying varies depending on the intended application, although an amount of 0.3 to 3.0 g/m$^2$ is generally preferred. At an image recording layer coating weight within this range, a good sensitivity and good image recording layer film properties are obtained.

Examples of suitable methods of coating include bar coating, spin coating, spray coating, curtain coating, dip coating, air knife coating, blade coating and roll coating.

[Undercoat]

In the presensitized plate of the invention, it is desirable to provide an undercoat between the image recording layer and the lithographic printing plate support.

The undercoat preferably contains a polymer having a substrate adsorbable group, a polymerizable group and a hydrophilic group.

An example of the polymer having a substrate adsorbable group, a polymerizable group and a hydrophilic group includes an undercoating polymer resin obtained by copolymerizing an adsorbable group-bearing monomer, a hydrophilic group-bearing monomer and a polymerizable reactive group (crosslinkable group)-bearing monomer.

Monomers described in paragraphs [0197] to [0210] of JP 2009-255434 A may be used for the undercoating polymer resin.

Various known methods may be used to apply the undercoat-forming coating liquid containing the constituents of the undercoat to the support. Examples of suitable methods of coating include bar coating, spin coating, spray coating, curtain coating, dip coating, air knife coating, blade coating and roll coating.

The coating weight (solids content) of the undercoat is preferably from 0.1 to 100 mg/m$^2$ and more preferably from 1 to 50 mg/m$^2$.

[Protective Layer]

In the presensitized plate of the invention, the image recording layer may optionally have a protective layer formed thereon to prevent scuffing and other damage to the image recording layer, to serve as an oxygen barrier, and to prevent ablation during exposure to a high-intensity laser.

The protective layer has heretofore been variously studied and is described in detail in, for example, U.S. Pat. No. 3,458,311 and JP 55-49729 B.

Exemplary materials that may be used for the protective layer include those described in paragraphs [0213] to [02227] of JP 2009-255434 A (e.g., water-soluble polymer compounds and inorganic layered compounds).

The thus prepared protective layer-forming coating liquid is applied onto the image recording layer provided on the support and dried to form the protective layer. The coating solvent may be selected as appropriate in connection with the binder, but distilled water and purified water are preferably used in cases where a water-soluble polymer is employed. Examples of the coating method used to form the protective layer include, but are not limited to, blade coating, air knife coating, gravure coating, roll coating, spray coating, dip coating and bar coating.

The coating weight after drying of the protective layer is preferably from 0.01 to 10 g/m$^2$, more preferably from 0.02 to 3 g/m$^2$, and most preferably from 0.02 to 1 g/m$^2$.

The presensitized plate according to the invention which has the image recording layer as described above exhibits excellent deinking ability after suspended printing and a long press life in the lithographic printing plate formed therefrom and exhibits improved on-press developability in the case of an on-press development type.

EXAMPLES

The invention is described below in detail by way of examples. However, the invention should not be construed as being limited to the following examples.

[Manufacture of Lithographic Printing Plate Support]

Aluminum alloy plates of material type 1S with a thickness of 0.3 mm were subjected to one of the treatments (A) to (F) which is shown in Table 1 to thereby manufacture lithographic printing plate supports. Rinsing treatment was performed between the respective treatment steps and the water remaining after rinsing treatment was removed with nip rollers.

[Treatment A]

(A-a) Mechanical Graining Treatment (Brush Graining)

Figure 5:
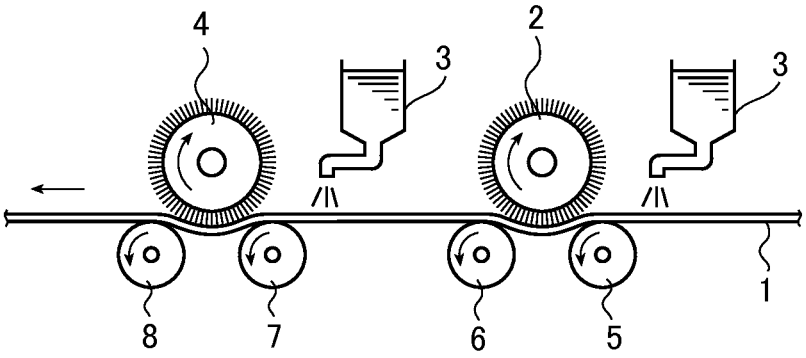
FIG. 5 is a side view illustrating the concept of a brush graining step that may be used to carry out mechanical graining treatment in the manufacture of the lithographic printing plate support of the invention.

Mechanical graining treatment was performed with rotating bristle bundle brushes of an apparatus as shown in FIG. 5 while feeding an abrasive slurry in the form of a suspension of pumice having a specific gravity of 1.1 g/cm$^3$ to the surface of the aluminum plate. FIG. 5 shows an aluminum plate 1, roller-type brushes (bristle bundle brushes in Examples) 2 and 4, an abrasive slurry 3, and support rollers 5, 6, 7 and 8.

Mechanical graining treatment was carried out using an abrasive having a median diameter (μm) of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(A-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(A-c) Desmutting Treatment in Aqueous Acid Solution

Next, desmutting treatment was performed in an aqueous nitric acid solution. The nitric acid wastewater from the subsequent electrochemical graining treatment step was used as the aqueous nitric acid solution in desmutting treatment. The solution temperature was 35° C. Desmutting treatment was performed by spraying the plate with the desmutting solution for 3 seconds.

(A-d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used. The current density at the current peak was 30 A/dm$^2$. Of the current that flows from the power supply, 5% was diverted to the auxiliary anode. The amount of electricity (C/dm$^2$), which is the total amount of electricity when the aluminum plate serves as an anode, was 185 C/dm$^2$. The plate was then rinsed by spraying with water.

(A-e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(A-f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(A-g) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used.

The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The plate was then rinsed by spraying with water.

(A-h) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(A-i) Desmutting Treatment in Aqueous Acid Solution

Next, desmutting treatment was performed in an aqueous sulfuric acid solution. More specifically, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(A-j) First Anodizing Treatment

Figure 6:
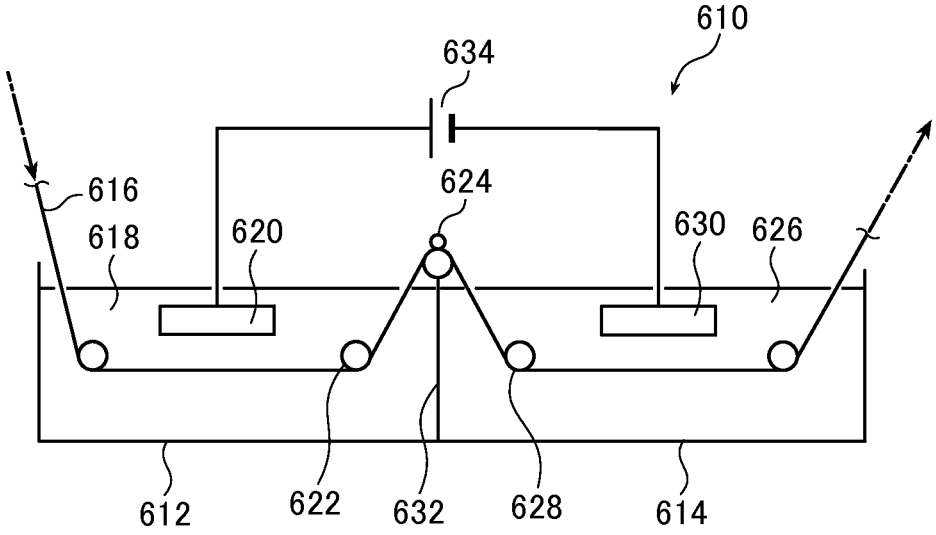
FIG. 6 is a schematic view of an anodizing apparatus that may be used to carry out anodizing treatment in the manufacture of the lithographic printing plate support of the invention.

The first anodizing treatment was performed by DC electrolysis using an anodizing apparatus of the structure as shown in FIG. 6. The anodizing treatment was performed under the conditions shown in Table 1 to form the anodized film with a specified film thickness.

(A-k) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(A-l) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(A-m) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

[Treatment (B)]

(B-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 1.0 g/m$^2$.

(B-b) Desmutting Treatment in Aqueous Acid Solution (First Desmutting Treatment)

Next, desmutting treatment was performed in an aqueous acid solution. The aqueous acid solution used in desmutting treatment contained 150 g/L of sulfuric acid. The solution temperature was 30° C. Desmutting treatment was performed by spraying the plate with the desmutting solution for 3 seconds. Then, rinsing treatment was carried out.

(B-c) Electrochemical Graining Treatment in Aqueous Hydrochloric Acid Solution

Next, electrolytic graining treatment was carried out using an alternating current in an electrolytic solution having a hydrochloric acid concentration of 14 g/L, an aluminum ion concentration of 13 g/L and a sulfuric acid concentration of 3 g/L. The electrolytic solution has a temperature of 30° C. Aluminum chloride was added to adjust the aluminum ion concentration.

The alternating current had a sinusoidal waveform whose positive and negative sides were symmetric; the frequency was 50 Hz; the ratio of the anodic reaction time to the cathodic reaction time in one cycle of alternating current was 1:1; and the current density at the current peak in the AC waveform was 75 A/dm$^2$. The total amount of electricity furnished for the anodic reaction on the aluminum plate was 450 C/dm$^2$ and the aluminum plate was electrolyzed four times by respectively applying 125 C/dm$^2$ of electricity at intervals of 4 seconds. A carbon electrode was used as the counter electrode of the aluminum plate. Then, rinsing treatment was carried out.

(B-d) Alkali Etching Treatment

Etching treatment was performed by using a spray line to spray the aluminum plate having undergone electrochemical graining treatment with an aqueous solution having a sodium hydroxide concentration of 5 wt %, an aluminum ion concentration of 0.5 wt %, and a temperature of 35° C. The amount of aluminum dissolved from the surface having undergone electrochemical graining treatment was 0.1 g/m$^2$. Then, rinsing treatment was carried out.

(B-e) Desmutting Treatment in Aqueous Acid Solution

Next, desmutting treatment was performed in an aqueous acid solution. The aqueous acid solution used in desmutting treatment was wastewater generated in the anodizing treatment step (aqueous solution containing 170 g/L of sulfuric acid and 5.0 g/L of aluminum ions dissolved therein). The solution temperature was 30° C. Desmutting treatment was performed by spraying the plate with the desmutting solution for 3 seconds.

(B-f) First Anodizing Treatment

The first anodizing treatment was performed by DC electrolysis using an anodizing apparatus of the structure as shown in FIG. 6. The anodizing treatment was performed under the conditions shown in Table 1 to form the anodized film with a specified film thickness.

(B-g) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(B-h) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(B-i) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

[Treatment (C)]

(C-a) Mechanical Graining Treatment (Brush Graining)

Mechanical graining treatment was performed with rotating bristle bundle brushes of an apparatus as shown in FIG. 5 while feeding an abrasive slurry in the form of a suspension of pumice having a specific gravity of 1.1 g/cm$^3$ to the surface of the aluminum plate.

Mechanical graining treatment was carried out using an abrasive having a median diameter (μm) of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(C-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(C-c) Desmutting Treatment in Aqueous Acid Solution

Next, desmutting treatment was performed in an aqueous acid solution. The aqueous acid solution used in desmutting treatment was wastewater generated in the anodizing treatment step (aqueous solution containing 170 g/L of sulfuric acid and 5.0 g/L of aluminum ions dissolved therein). The solution temperature was 30° C. Desmutting treatment was performed by spraying the plate with the desmutting solution for 3 seconds.

(C-d) First Anodizing Treatment

The first anodizing treatment was performed by DC electrolysis using an anodizing apparatus of the structure as shown in FIG. 6. The anodizing treatment was performed under the conditions shown in Table 1 to form the anodized film with a specified film thickness.

(C-e) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(C-f) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(C-g) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

[Treatment (D)]

(D-a) Mechanical Graining Treatment (Brush Graining)

Mechanical graining treatment was performed with rotating bristle bundle brushes of an apparatus as shown in FIG. 5 while feeding an abrasive slurry in the form of a suspension of pumice having a specific gravity of 1.1 g/cm$^3$ to the surface of the aluminum plate.

Mechanical graining treatment was carried out using an abrasive having a median diameter (μm) of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(D-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(D-c) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(D-d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used. The current density at the current peak was 30 A/dm$^2$. Of the current that flows from the power supply, 5% was diverted to the auxiliary anode. The amount of electricity (C/dm$^2$), which is the total amount of electricity when the aluminum plate serves as an anode, was 185 C/dm$^2$. The plate was then rinsed by spraying with water.

(D-e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(D-f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(D-g) First Anodizing Treatment

The first anodizing treatment was performed by DC electrolysis using an anodizing apparatus of the structure as shown in FIG. 6. The anodizing treatment was performed under the conditions shown in Table 1 to form the anodized film with a specified film thickness.

(D-h) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(D-i) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(D-j) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

[Treatment (E)]

(E-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 5 g/m$^2$.

(E-b) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(E-c) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used. The current density at the current peak was 30 A/dm$^2$. Of the current that flows from the power supply, 5% was diverted to the auxiliary anode. The amount of electricity (C/dm$^2$), which is the total amount of electricity when the aluminum plate serves as an anode, was 250 C/dm$^2$. The plate was then rinsed by spraying with water.

(E-d) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.2 g/m$^2$.

(E-e) Desmutting Treatment in Aqueous Acid Solution

Next, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed in the aqueous sulfuric acid solution. Desmutting treatment was performed by spraying the plate with the desmutting solution for 3 seconds.

(E-f) First Anodizing Treatment

The first anodizing treatment was performed by DC electrolysis using an anodizing apparatus of the structure as shown in FIG. 6. The anodizing treatment was performed under the conditions shown in Table 1 to form the anodized film with a specified film thickness.

(E-g) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(E-h) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(E-i) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

[Treatment (F)]

(F-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 5 g/m$^2$.

(F-b) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(F-c) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used. The current density at the current peak was 30 A/dm$^2$. Of the current that flows from the power supply, 5% was diverted to the auxiliary anode. The amount of electricity (C/dm$^2$), which is the total amount of electricity when the aluminum plate serves as an anode, was 250 C/dm$^2$. The plate was then rinsed by spraying with water.

(F-d) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.2 g/m$^2$.

(F-g) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(F-h) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 3 and electrochemical graining treatment was carried out for a period of time tp until the current reached a peak from zero of 0.8 ms, at a duty ratio of 1:1, using an alternating current having a trapezoidal waveform, and with a carbon electrode as the counter electrode. A ferrite was used for the auxiliary anode. An electrolytic cell of the type shown in FIG. 4 was used. The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The plate was then rinsed by spraying with water.

(F-i) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(F-j) Desmutting Treatment in Aqueous Acid Solution

Next, desmutting treatment was performed in an aqueous sulfuric acid solution. More specifically, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(F-k) First Anodizing Treatment

The first anodizing treatment was performed by DC electrolysis using an anodizing apparatus of the structure as shown in FIG. 6. The anodizing treatment was performed under the conditions shown in Table 1 to form the anodized film with a specified film thickness.

(F-l) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

(F-m) Second Anodizing Treatment

The second anodizing treatment was performed by DC electrolysis using an anodizing apparatus of the structure as shown in FIG. 6. The anodizing treatment was performed under the conditions shown in Table 1 to form the anodized film with a specified film thickness.

(F-n) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 10 mg/m$^2$. The plate was then rinsed by spraying with water.

The average diameter at the anodized film surface of the large-diameter portions in the micropore-bearing anodized film obtained after the second anodizing treatment step, the communication position average diameter of the small-diameter portions, the depths are all shown in Table 2.

The average diameters of the micropores (average diameter of the large-diameter portions and that of the small-diameter portions) were determined as follows: The anodized film showing the aperture surfaces of the large-diameter portions and those of the small-diameter portions was taken by FE-SEM at a magnification of 150,000× to obtain four images, and in the resulting four images, the diameter of the micropores, that is, the diameter of the large-diameter portions and that of the small-diameter portions were measured within an area of 400×600 nm$^2$ and the average of the measurements was calculated. When it was difficult to measure the diameter of the small-diameter portions because of the large depth of the large-diameter portions, the upper portion of the anodized film (the region including the large-diameter portions) was optionally cut out to determine the diameter of the small-diameter portions.

The depths of the micropores, that is, the depth of the large-diameter portions and that of the small-diameter portions were determined as follows: The cross-sectional surface of the support (anodized film) was taken by FE-SEM at a magnification of 150,000× to observe the depth of the large-diameter portions and a magnification of 50,000× to observe the depth of the small-diameter portions, and in the resulting images, the depth of arbitrarily selected 25 micropores was measured and the average of the measurements was calculated.

In Table 2, The AD weight in the column of First anodizing treatment and that in the column of Second anodizing treatment represent the coating weights obtained in the respective treatments. The electrolytic solution used is an aqueous solution containing the ingredients shown in Table 1.

TABLE 1

| | | First anodizing treatment | | | | | | | | Pore-widening treatment | | | | |
|---|---|---|---|---|---|---|---|---|---|---|---|---|---|---|
| | Treat-ment condi-tion | Solution type | Solution | Conc. (g/l) | Temp. (° C.) | Current density ($A/dm^2$) | Pore depth (nm) | Film thick-ness (nm) | AD weight ($g/m^2$) | Solution type | Solution | Conc. wt %) | Temp. (° C.) | Time (s) |
| EX 1 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 2 | A | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 3 | A | Sulfuric acid | $H_2SO_4$/Al | 170/7 | 43 | 30 | 32 | 57 | 0.15 | Sodium hydroxide | NaOH/Al | 5/0.5 | 35 | 4 |
| EX 4 | A | Sulfuric acid | $H_2SO_4$/Al | 170/7 | 43 | 50 | 63 | 88 | 0.23 | Sodium hydroxide | NaOH/Al | 5/0.5 | 35 | 16 |
| EX 5 | A | Sulfuric acid | $H_2SO_4$/Al | 170/7 | 43 | 50 | 70 | 95 | 0.25 | Sodium hydroxide | NaOH/Al | 5/0.5 | 35 | 20 |
| EX 6 | A | Sulfuric acid | $H_2SO_4$/Al | 170/7 | 43 | 30 | 13 | 38 | 0.10 | Sodium hydroxide | NaOH/Al | 5/0.5 | 35 | 4 |
| EX 7 | A | Sulfuric acid | $H_2SO_4$/Al | 170/7 | 43 | 30 | 21 | 46 | 0.12 | Sodium hydroxide | NaOH/Al | 5/0.5 | 35 | 6 |
| EX 8 | A | Sulfuric acid | $H_2SO_4$/Al | 170/7 | 43 | 30 | 56 | 81 | 0.21 | Sodium hydroxide | NaOH/Al | 5/0.5 | 35 | 6 |
| EX 9 | A | Sulfuric acid | $H_2SO_4$/Al | 170/7 | 43 | 50 | 91 | 116 | 0.30 | Sodium hydroxide | NaOH/Al | 5/0.5 | 35 | 12 |
| EX 10 | A | Sulfuric acid | $H_2SO_4$/Al | 170/7 | 43 | 50 | 41 | 66 | 0.17 | Sodium hydroxide | NaOH/Al | 5/0.5 | 35 | 12 |
| EX 11 | A | Sulfuric acid | $H_2SO_4$/Al | 170/7 | 43 | 50 | 46 | 71 | 0.18 | Sodium hydroxide | NaOH/Al | 5/0.5 | 35 | 12 |
| EX 12 | A | Sulfuric acid | $H_2SO_4$/Al | 170/7 | 43 | 30 | 37 | 62 | 0.16 | Sodium hydroxide | NaOH/Al | 5/0.5 | 35 | 1 |
| EX 13 | A | Sulfuric acid | $H_2SO_4$/Al | 170/7 | 43 | 30 | 47 | 72 | 0.19 | Sodium hydroxide | NaOH/Al | 5/0.5 | 35 | 1 |
| EX 14 | A | Sulfuric acid | $H_2SO_4$/Al | 170/7 | 43 | 60 | 51 | 76 | 0.20 | Sodium hydroxide | NaOH/Al | 5/0.5 | 35 | 6 |
| EX 15 | A | Sulfuric acid | $H_2SO_4$/Al | 170/7 | 43 | 50 | 46 | 71 | 0.18 | Sodium hydroxide | NaOH/Al | 5/0.5 | 35 | 6 |
| EX 16 | A | Sulfuric acid | $H_2SO_4$/Al | 170/7 | 43 | 10 | 26 | 51 | 0.13 | Sodium hydroxide | NaOH/Al | 5/0.5 | 35 | 6 |
| EX 17 | A | Sulfuric acid | $H_2SO_4$/Al | 170/7 | 43 | 5 | 21 | 46 | 0.12 | Sodium hydroxide | NaOH/Al | 5/0.5 | 35 | 6 |
| EX 18 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 19 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 20 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 21 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 22 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| EX 23 | A | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 24 | B | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 25 | C | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 26 | D | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 27 | E | Sulfuric acid | $H_2SO_4$/Al | 170/7 | 43 | 30 | 27 | 52 | 0.13 | Sodium hydroxide | NaOH/Al | 5/0.5 | 35 | 1 |
| EX 28 | F | Sulfuric acid | $H_2SO_4$/Al | 170/7 | 43 | 30 | 27 | 52 | 0.13 | Sodium hydroxide | NaOH/Al | 5/0.5 | 35 | 1 |

| | Second anodizing treatment | | | | | | |
|---|---|---|---|---|---|---|---|
| | Solution type | Solution | Conc. (g/l) | Temp. (° C.) | Current density ($A/dm^2$) | Film thickness (nm) | AD weight ($g/m^2$) |
| EX 1 | Sulfuric acid | $H_2SO_4$/Al | 170/7 | 40 | 20 | 1000 | 2.6 |
| EX 2 | Sulfuric acid | $H_2SO_4$/Al | 170/7 | 40 | 20 | 1000 | 2.6 |
| EX 3 | Sulfuric acid | $H_2SO_4$/Al | 170/7 | 40 | 20 | 1000 | 2.6 |
| EX 4 | Sulfuric acid | $H_2SO_4$/Al | 170/7 | 40 | 20 | 1000 | 2.6 |

TABLE 1-continued

| | | | | | | | |
|---|---|---|---|---|---|---|---|
| EX 5 | Sulfuric acid | $H_2SO_4$/Al | 170/7 | 40 | 20 | 1000 | 2.6 |
| EX 6 | Sulfuric acid | $H_2SO_4$/Al | 170/7 | 40 | 20 | 1000 | 2.6 |
| EX 7 | Sulfuric acid | $H_2SO_4$/Al | 170/7 | 40 | 20 | 1000 | 2.6 |
| EX 8 | Sulfuric acid | $H_2SO_4$/Al | 170/7 | 40 | 20 | 1000 | 2.6 |
| EX 9 | Sulfuric acid | $H_2SO_4$/Al | 170/7 | 40 | 20 | 1000 | 2.6 |
| EX 10 | Sulfuric acid | $H_2SO_4$/Al | 170/7 | 40 | 20 | 1000 | 2.6 |
| EX 11 | Sulfuric acid | $H_2SO_4$/Al | 170/7 | 40 | 20 | 1000 | 2.6 |
| EX 12 | Sulfuric acid | $H_2SO_4$/Al | 170/7 | 40 | 20 | 1000 | 2.6 |
| EX 13 | Sulfuric acid | $H_2SO_4$/Al | 170/7 | 40 | 20 | 1000 | 2.6 |
| EX 14 | Sulfuric acid | $H_2SO_4$/Al | 170/7 | 40 | 20 | 1000 | 2.6 |
| EX 15 | Sulfuric acid | $H_2SO_4$/Al | 170/7 | 40 | 20 | 1000 | 2.6 |
| EX 16 | Sulfuric acid | $H_2SO_4$/Al | 170/7 | 40 | 20 | 1000 | 2.6 |
| EX 17 | Sulfuric acid | $H_2SO_4$/Al | 170/7 | 40 | 20 | 1000 | 2.6 |
| EX 18 | Phosphoric acid | $H_3PO_4$/Al | 5/0 | 30 | 10 | 1000 | 2.6 |
| EX 19 | Sulfuric acid | $H_2SO_4$/Al | 170/7 | 30 | 50 | 1000 | 2.6 |
| EX 20 | Sulfuric acid | $H_2SO_4$/Al | 170/7 | 40 | 5 | 1000 | 2.6 |
| EX 21 | Sulfuric acid | $H_2SO_4$/Al | 170/7 | 40 | 20 | 920 | 2.4 |
| EX 22 | Sulfuric acid | $H_2SO_4$/Al | 170/7 | 40 | 20 | 1900 | 4.9 |
| EX 23 | Sulfuric acid | $H_2SO_4$/Al | 170/7 | 55 | 40 | 1000 | 2.6 |
| EX 24 | Sulfuric acid | $H_2SO_4$/Al | 170/7 | 40 | 20 | 1000 | 2.6 |
| EX 25 | Sulfuric acid | $H_2SO_4$/Al | 170/7 | 40 | 20 | 1000 | 2.6 |
| EX 26 | Sulfuric acid | $H_2SO_4$/Al | 170/7 | 40 | 20 | 1000 | 2.6 |
| EX 27 | Sulfuric acid | $H_2SO_4$/Al | 170/7 | 40 | 20 | 1000 | 2.6 |
| EX 28 | Sulfuric acid | $H_2SO_4$/Al | 170/7 | 40 | 20 | 1000 | 2.6 |

TABLE 1

| | Treatment | First anodizing treatment | | | | | | | | Pore-widening treatment | | | | |
|---|---|---|---|---|---|---|---|---|---|---|---|---|---|---|
| | condition | Solution type | Solution | Conc. (g/l) | Temp. (° C.) | Current density (A/dm$^2$) | Pore depth (nm) | Film thickness (nm) | AD weight (g/m$^2$) | Solution type | Solution | Conc. (wt %) | Temp. (° C.) | Time (s) |
| CE 1 | A | Sulfuric acid | $H_2SO_4$/Al | 170/7 | 43 | 30 | 21 | 46 | 0.12 | Sodium hydroxide | NaOH/Al | 5/0.5 | 25 | 1 |
| CE 2 | A | Sulfuric acid | $H_2SO_4$/Al | 170/7 | 43 | 30 | 7 | 32 | 0.08 | Sodium hydroxide | NaOH/Al | 5/0.5 | 35 | 2 |
| CE 3 | A | Sulfuric acid | $H_2SO_4$/Al | 170/7 | 43 | 50 | 101 | 126 | 0.33 | Sodium hydroxide | NaOH/Al | 5/0.5 | 35 | 12 |
| CE 4 | A | Sulfuric acid | $H_2SO_4$/Al | 170/7 | 43 | 30 | 152 | 177 | 0.46 | Sodium hydroxide | NaOH/Al | 5/0.5 | 35 | 1 |
| CE 5 | A | Sulfuric acid | $H_2SO_4$/Al | 170/7 | 43 | 30 | 161 | 186 | 0.48 | Sodium hydroxide | NaOH/Al | 5/0.5 | 35 | 6 |
| CE 6 | A | Sulfuric acid | $H_2SO_4$/Al | 170/7 | 43 | 50 | 188 | 213 | 0.55 | Sodium hydroxide | NaOH/Al | 5/0.5 | 35 | 16 |
| CE 7 | A | Sulfuric acid | $H_2SO_4$/Al | 170/7 | 43 | 50 | 50 | 75 | 0.20 | Sodium hydroxide | NaOH/Al | 5/0.5 | 35 | 20 |
| CE 8 | A | Sulfuric acid | H2SO4/Al | 170/7 | 43 | 30 | 52 | 77 | 0.13 | Sodium hydroxide | NaOH/Al | 5/0.5 | 35 | 1 |
| CE 9 | A | Sulfuric acid | $H_2SO_4$/Al | 170/7 | 43 | 30 | 36 | 61 | 0.16 | Sodium hydroxide | NaOH/Al | 5/0.5 | 35 | 6 |

TABLE 1-continued

| | | | | | | | | | | | | | | |
|---|---|---|---|---|---|---|---|---|---|---|---|---|---|---|
| CE 10 | A | Sulfuric acid | $H_2SO_4$/Al | 170/7 | 43 | 30 | 36 | 61 | 0.16 | Sodium hydroxide | NaOH/Al | 5/0.5 | 35 | 6 |
| CE 11 | A | — | — | — | — | — | — | — | — | — | — | — | — | — |
| CE 12 | A | Sulfuric acid | $H_2SO_4$ | 170 | 30 | 5 | 298 | 308 | 0.80 | 10-second immersion at 30° C. in a solution of 0.1M $NaHCO_3$ and 0.1M $Na_2CO_3$ adjusted with NaOH to a pH of 13 | | | | |
| CE 13 | A | Phosphoric acid | $H_3PO_4$ | 50 | 30 | 1 | 301 | 346 | 0.90 | — | — | — | — | — |
| CE 14 | A | Oxalic acid | $(COOH)_2$ | 100 | 30 | 1 | 268 | 308 | 0.80 | — | — | — | — | — |
| CE 15 | A | Sulfuric acid | $H_2SO_4$ | 300 | 60 | 5 | 380 | 385 | 1.00 | — | — | — | — | — |
| CE 16 | A | Sulfuric acid | $H_2SO_4$ | 50 | 10 | 20 | 345 | 385 | 1.00 | — | — | — | — | — |
| CE 17 | B | — | — | — | — | — | — | — | — | — | — | — | — | — |
| CE 18 | C | — | — | — | — | — | — | — | — | — | — | — | — | — |
| CE 19 | D | — | — | — | — | — | — | — | — | — | — | — | — | — |
| CE 20 | E | — | — | — | — | — | — | — | — | — | — | — | — | — |
| CE 21 | F | — | — | — | — | — | — | — | — | — | — | — | — | — |

| | Second anodizing treatment | | | | | | |
|---|---|---|---|---|---|---|---|
| | Solution type | Solution | Conc. (g/l) | Temp. (° C.) | Current density (A/dm$^2$) | Film thickness (nm) | AD weight (g/m$^2$) |
| CE 1 | Sulfuric acid | $H_2SO_4$/Al | 170/7 | 40 | 20 | 1000 | 2.6 |
| CE 2 | Sulfuric acid | $H_2SO_4$/Al | 170/7 | 40 | 20 | 1000 | 2.6 |
| CE 3 | Sulfuric acid | $H_2SO_4$/Al | 170/7 | 40 | 20 | 1000 | 2.6 |
| CE 4 | Sulfuric acid | $H_2SO_4$/Al | 170/7 | 40 | 20 | 1000 | 2.6 |
| CE 5 | Sulfuric acid | $H_2SO_4$/Al | 170/7 | 40 | 20 | 1000 | 2.6 |
| CE 6 | Sulfuric acid | $H_2SO_4$/Al | 170/7 | 40 | 20 | 1000 | 2.6 |
| CE 7 | Sulfuric acid | $H_2SO_4$/Al | 170/7 | 40 | 20 | 1000 | 2.6 |
| CE 8 | Sulfuric acid | $H_2SO_4$/Al | 170/7 | 40 | 20 | 1000 | 2.6 |
| CE 9 | Phosphoric acid | $H_3PO_4$/Al | 5/0 | 30 | 20 | 1000 | 2.6 |
| CE 10 | Sulfuric acid | $H_2SO_4$/Al | 170/7 | 40 | 20 | 850 | 2.2 |
| CE 11 | Sulfuric acid | $H_2SO_4$/Al | 170/7 | 40 | 20 | 1000 | 2.6 |
| CE 12 | Sulfuric acid | $H_2SO_4$ | 170 | 30 | 5 | 846 | 2.2 |
| CE 13 | Sulfuric acid | $H_2SO_4$ | 170 | 30 | 1 | 654 | 1.7 |
| CE 14 | Sulfuric acid | $H_2SO_4$ | 170 | 30 | 5 | 692 | 1.8 |
| CE 15 | Sulfuric acid | $H_2SO_4$ | 170 | 30 | 5 | 654 | 1.7 |
| CE 16 | Sulfuric acid | $H_2SO_4$ | 170 | 30 | 5 | 654 | 1.7 |
| CE 17 | Sulfuric acid | $H_2SO_4$/Al | 170/7 | 40 | 20 | 1000 | 2.6 |
| CE 18 | Sulfuric acid | $H_2SO_4$/Al | 170/7 | 40 | 20 | 1000 | 2.6 |
| CE 19 | Sulfuric acid | $H_2SO_4$/Al | 170/7 | 40 | 20 | 1000 | 2.6 |
| CE 20 | Sulfuric acid | $H_2SO_4$/Al | 170/7 | 40 | 20 | 1000 | 2.6 |

TABLE 1-continued

| | | | | | | | | |
|---|---|---|---|---|---|---|---|---|
| | | CE 21 | Sulfuric acid | $H_2SO_4$/Al | 170/7 | 40 | 20 | 1000 | 2.6 |

TABLE 2

| | Micropore | | | | | | |
|---|---|---|---|---|---|---|---|
| | Large-diameter portion | | | Small-diameter portion | | | Ratio (small-diameter |
| | Average diameter(nm) | Depth(nm) | Depth/Average diameter | Average diameter(nm) | Depth(nm) | Pit density (pcs/μm$^2$) | portion/large-diameter portion) |
| EX 1 | 25 | 25 | 1.00 | 8 | 980 | 500 | 0.32 |
| EX 2 | 12 | 25 | 2.08 | 8 | 980 | 500 | 0.67 |
| EX 3 | 20 | 25 | 1.25 | 8 | 980 | 500 | 0.40 |
| EX 4 | 50 | 25 | 0.50 | 8 | 980 | 200 | 0.16 |
| EX 5 | 60 | 25 | 0.42 | 8 | 980 | 200 | 0.13 |
| EX 6 | 20 | 6 | 0.30 | 8 | 980 | 500 | 0.40 |
| EX 7 | 25 | 10 | 0.40 | 8 | 980 | 500 | 0.32 |
| EX 8 | 25 | 45 | 1.80 | 8 | 980 | 500 | 0.32 |
| EX 9 | 40 | 60 | 1.50 | 8 | 980 | 200 | 0.20 |
| EX 10 | 40 | 10 | 0.25 | 8 | 980 | 200 | 0.20 |
| EX 11 | 40 | 15 | 0.38 | 8 | 980 | 200 | 0.20 |
| EX 12 | 12 | 35 | 2.92 | 8 | 980 | 500 | 0.67 |
| EX 13 | 12 | 45 | 3.75 | 8 | 980 | 500 | 0.67 |
| EX 14 | 25 | 25 | 1.00 | 8 | 980 | 55 | 0.32 |
| EX 15 | 25 | 25 | 1.00 | 8 | 980 | 200 | 0.32 |
| EX 16 | 25 | 25 | 1.00 | 8 | 980 | 2800 | 0.32 |
| EX 17 | 25 | 25 | 1.00 | 8 | 980 | 3800 | 0.32 |
| EX 18 | 25 | 25 | 1.00 | 19 | 960 | 500 | 0.76 |
| EX 19 | 25 | 25 | 1.00 | 13 | 973 | 500 | 0.52 |
| EX 20 | 25 | 25 | 1.00 | 5 | 990 | 500 | 0.20 |
| EX 21 | 25 | 25 | 1.00 | 8 | 900 | 500 | 0.32 |
| EX 22 | 25 | 25 | 1.00 | 8 | 1880 | 500 | 0.32 |
| EX 23 | 12 | 25 | 2.08 | 10 | 970 | 500 | 0.83 |
| EX 24 | 12 | 25 | 2.08 | 8 | 980 | 500 | 0.67 |
| EX 25 | 12 | 25 | 2.08 | 8 | 980 | 500 | 0.67 |
| EX 26 | 12 | 25 | 2.08 | 8 | 980 | 500 | 0.67 |
| EX 27 | 12 | 25 | 2.08 | 8 | 980 | 500 | 0.67 |
| EX 28 | 12 | 25 | 2.08 | 8 | 980 | 500 | 0.67 |
| CE 1 | 9 | 20 | 2.22 | 8 | 980 | 500 | 0.89 |
| CE 2 | 15 | 3 | 0.20 | 8 | 980 | 500 | 0.53 |
| CE 3 | 40 | 70 | 1.75 | 8 | 980 | 200 | 0.20 |
| CE 4 | 12 | 150 | 12.50 | 8 | 980 | 500 | 0.67 |
| CE 5 | 25 | 150 | 6.00 | 8 | 980 | 500 | 0.32 |
| CE 6 | 50 | 150 | 3.00 | 8 | 980 | 200 | 0.16 |
| CE 7 | 60 | 5 | 0.08 | 8 | 980 | 200 | 0.13 |
| CE 8 | 12 | 50 | 4.17 | 8 | 980 | 500 | 0.67 |
| CE 9 | 25 | 25 | 1.00 | 22 | 950 | 500 | 0.88 |
| CE 10 | 25 | 25 | 1.00 | 8 | 830 | 500 | 0.32 |
| CE 11 | — | — | — | 8 | 980 | — | — |
| CE 12 | 17 | 268 | 15.76 | 8 | 836 | 3500 | 0.47 |
| CE 13 | 40 | 301 | 7.53 | 5 | 649 | 800 | 0.13 |
| CE 14 | 20 | 268 | 13.40 | 8 | 682 | 900 | 0.40 |
| CE 15 | 16 | 380 | 23.75 | 8 | 644 | 5000 | 0.50 |
| CE 16 | 15 | 345 | 23.00 | 8 | 644 | 25 | 0.53 |
| CE 17 | — | — | — | 8 | 980 | — | — |
| CE 18 | — | — | — | 8 | 980 | — | — |
| CE 19 | — | — | — | 8 | 980 | — | — |
| CE 20 | — | — | — | 8 | 980 | — | — |
| CE 21 | — | — | — | 8 | 980 | — | — |

In Examples 1 to 28, micropores having specified average diameters and depths were formed in the anodized aluminum film.

Comparative Examples 11 and 17-21 apply the conventional process in which anodizing treatment is performed only once. The manufacturing conditions in Comparative Examples 12 to 16 are the same as those in Examples 1 to 5 described in paragraph [0136] of JP 11-219657 A.

[Manufacture of Presensitized Plate]

An undercoat-forming coating liquid of the composition indicated below was applied onto each lithographic printing plate support manufactured as described above to a dry coating weight of 28 mg/m$^2$ to thereby form an undercoat.

| <Undercoat-Forming Coating Liquid> | |
|---|---|
| Undercoating compound (1) of the structure shown below | 0.18 g |
| Hydroxyethyliminodiacetic acid | 0.10 g |
| Methanol | 55.24 g |
| Water | 6.15 g |

[Chemical Formula 1]

Undercoating compound (1)

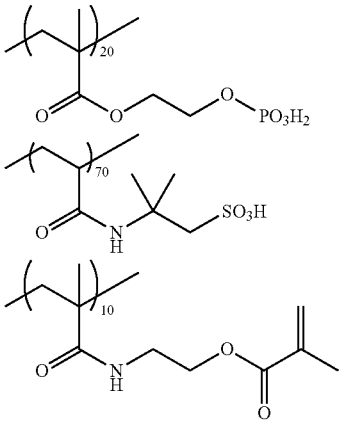

Then, an image recording layer-forming coating liquid was applied onto the thus formed undercoat by bar coating and dried in an oven at 100° C. for 60 seconds to form an image recording layer having a dry coating weight of 1.3 g/m$^2$.

The image recording layer-forming coating liquid was obtained by mixing with stirring the photosensitive liquid and microgel liquid just before use in application.

| <Photosensitive Liquid> | |
|---|---|
| Binder polymer (1)<br>[its structure is shown below] | 0.24 g |
| Infrared absorber (1)<br>[its structure is shown below] | 0.030 g |
| Radical polymerization initiator (1)<br>[its structure is shown below] | 0.162 g |
| Polymerizable compound,<br>tris(acryloyloxyethyl)isocyanurate<br>(NK ester A-9300 available from<br>Shin-Nakamura Chemical Corporation) | 0.192 g |
| Low-molecular-weight hydrophilic compound,<br>tris(2-hydroxyethyl)isocyanurate | 0.062 g |
| Low-molecular-weight hydrophilic compound (1)<br>[its structure is shown below] | 0.052 g |
| Sensitizer<br>Phosphonium compound (1)<br>[its structure is shown below] | 0.055 g |
| Sensitizer<br>Benzyl-dimethyl-octyl ammonium•$PF_6$ salt | 0.018 g |
| Betaine compound (C-1)<br>[its structure is shown below] | 0.010 g |
| Fluorosurfactant (1)<br>(weight-average molecular weight: 10,000)<br>[its structure is shown below] | 0.008 g |
| Methyl ethyl ketone | 1.091 g |
| 1-Methoxy-2-propanol | 8.609 g |

| <Microgel Liquid> | |
|---|---|
| Microgel (1) | 2.640 g |
| Distilled water | 2.425 g |

The binder polymer (1), the infrared absorber (1), the radical polymerization initiator (1), the phosphonium compound (1), the low-molecular-weight hydrophilic compound (1) and the fluorosurfactant (1) have the structures represented by the following formulas:

[Chemical Formula 2]

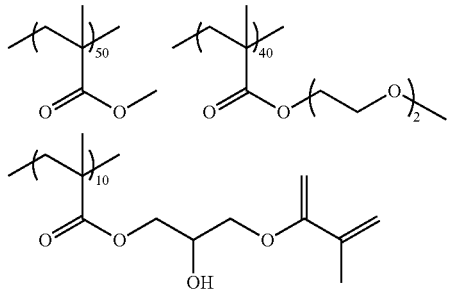

Binder polymer (1)
(Mw 70,000)

[Chemical Formula 3]

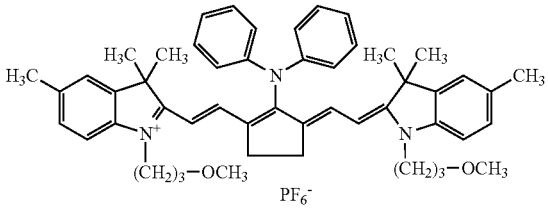

Infrared absorber (1)

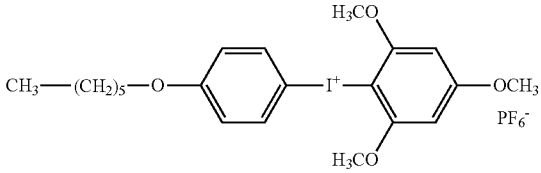

Polymerization initiator (1)

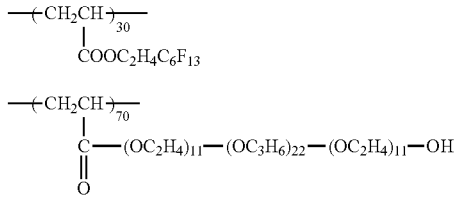

Fluorosurfactant (1)

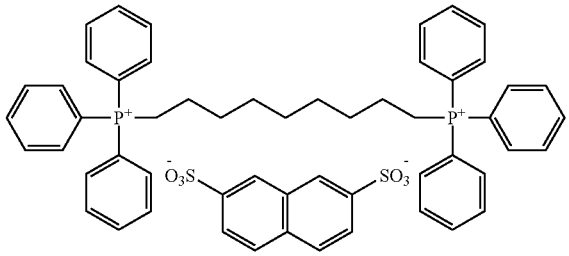

Phosphonium compound (1)

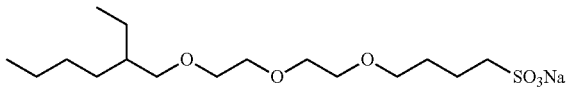

Low-molecular-weight hydrophilic compound (1)

(C-1)

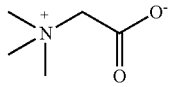

The microgel (1) was synthesized by the following procedure.

<Synthesis of Microgel (1)>

For the oil phase component, 10 g of an adduct of trimethylolpropane with xylene diisocyanate (Takenate D-110N available from Mitsui Takeda Chemicals Inc.), 3.15 g of pentaerythritol triacrylate (SR444 available from Nippon Kayaku Co., Ltd.) and 0.1 g of Pionin A-41C (available from Takemoto Oil & Fat Co., Ltd.) were dissolved in 17 g of ethyl acetate. For the aqueous phase component, 40 g of a 4 wt % aqueous solution of PVA-205 was prepared. The oil phase component and the aqueous phase component were mixed and emulsified in a homogenizer at 12,000 rpm for 10 minutes. The resulting emulsion was added to 25 g of distilled water and the mixture was stirred at room temperature for 30 minutes, then at 50° C. for 3 hours. The thus obtained microgel liquid was diluted with distilled water so as to have a solids concentration of 15 wt % and used as the microgel (1). The average particle size of the microgel as measured by a light scattering method was 0.2 μm.

Then, a protective layer-forming coating liquid of the composition indicated below was applied onto the thus formed image recording layer by bar coating and dried in an oven at 120° C. for 60 seconds to form a protective layer having a dry coating weight of 0.15 g/m$^2$, thereby obtaining a presensitized plate.

| <Protective Layer-Forming Coating Liquid> | |
|---|---|
| Dispersion of an inorganic layered compound (1) | 1.5 g |
| 6 wt % Aqueous solution of polyvinyl alcohol (CKS50; modified with sulfonic acid; degree of saponification: at least 99 mol %; degree of polymerization: 300; available from Nippon Synthetic Chemical Industry Co., Ltd.) | 0.55 g |
| 6 wt % Aqueous solution of polyvinyl alcohol (PVA-405; degree of saponification: 81.5 mol %; degree of polymerization: 500; available from Kuraray Co., Ltd.) | 0.03 g |
| 1 wt % Aqueous solution of surfactant (EMALEX 710 available from Nihon Emulsion Co., Ltd.) | 8.60 g |
| Ion exchanged water | 6.0 g |

The dispersion of the inorganic layered compound (1) was prepared by the following procedure.

(Preparation of Dispersion of Inorganic Layered Compound (1))

To 193.6 g of ion exchanged water was added 6.4 g of synthetic mica Somasif ME-100 (available from Co-Op Chemical Co., Ltd.) and the mixture was dispersed in a homogenizer to an average particle size as measured by a laser scattering method of 3 μm. The resulting dispersed particles had an aspect ratio of at least 100.

[Evaluation of Presensitized Plate]

(On-Press Developability)

The resulting presensitized plate was exposed by Luxel PLATESETTER T-6000III from FUJIFILM Corporation equipped with an infrared semiconductor laser at an external drum rotation speed of 1,000 rpm, a laser power of 70% and a resolution of 2,400 dpi. The exposed image was set to contain a solid image and a 50% halftone chart of a 20 μm-dot FM screen.

The resulting presensitized plate after exposure was mounted without development process on the plate cylinder of a Lithrone 26 printing press (Komori Corporation). A fountain solution Ecality-2 (FUJIFILM Corporation)/tap water at a volume ratio of 2/98 and Values-G (N) black ink (Dainippon Ink & Chemicals, Inc.) were used. The fountain solution and the ink were supplied by the standard automatic printing start-up procedure on the Lithrone 26 to perform on-press development, and 100 impressions were printed on Tokubishi art paper (76.5 kg) at a printing speed of 10,000 impressions per hour.

The on-press developability was evaluated by the number of sheets of printing paper required to reach the state in which no ink is transferred to halftone non-image areas after the completion of the on-press development of the unexposed areas of the 50% halftone chart on the printing press. The on-press developability was rated "very good" when the number of wasted sheets was up to 20, "good" when the number of wasted sheets was from 21 to 30, "fair" when the number of wasted sheets was 31 to 40, and "poor" when the number of wasted sheets was 41 or more. The results are shown in Table 3. The on-press developability is preferably not rated "poor" for practical use.

(Deinking Ability After Suspended Printing)

Once good impressions were obtained after the end of the on-press development, printing was suspended and the printing plate was left to stand on the printing press for 1 hour in a room at a temperature of 25° C. and a humidity of 50%. Then, printing was resumed and the deinking ability after suspended printing was evaluated by the number of sheets of printing paper required to obtain a good unstained impression. The deinking ability after suspended printing was rated "very good" when the number of wasted sheets was up to 75, "good" when the number of wasted sheets was 76 to 200, "fair" when the number of wasted sheets was 201 to 300 and "poor" when the number of wasted sheets was 301 or more. The results are shown in Table 3. The on-press developability is preferably not rated "poor" for practical use.

(Press Life)

On-press development was performed on the same type of printing press by the same procedure as above and printing was further continued. The press life was evaluated by the number of impressions at the time when the decrease in density of a solid image became visually recognizable. The press life was rated "extremely poor" when the number of impressions was less than 10,000, "very poor" when the number of impressions was at least 10,000 but less than 15,000, "poor" when the number of impressions was at least 15,000 but less than 20,000, "good" when the number of impressions was at least 20,000 but less than 25,000, "very good" when the number of impressions was at least 25,000 but less than 30,000, and "excellent" when the number of impressions was 30,000 or more. The results are shown in Table 3.

The press life is preferably not rated "extremely poor", "very poor" and "poor" for practical use.

(Scratch Resistance)

The surface of the resulting lithographic printing plate support was subjected to a scratch test to evaluate the scratch resistance of the lithographic printing plate support.

The scratch test was performed using a continuous loading scratching intensity tester (SB-53 manufactured by Shinto Scientific Co., Ltd.) while moving a sapphire needle with a diameter of 0.4 mm at a moving velocity of 10 cm/s at a load of 100 g.

As a result, the support in which scratches due to the needle did not reach the surface of the aluminum alloy plate (base) was rated "good" as having excellent scratch resistance and the support in which scratches reached the plate surface was rated "poor." The lithographic printing plate support exhibiting excellent scratch resistance at a load of 100 g can suppress the transfer of scratches to the image recording layer when the presensitized plate prepared therefrom is mounted on the plate cylinder or superposed on another, thus reducing scumming in non-image areas.

TABLE 4

| | Press life | Deinking ability after suspended printing | On-press developability | Scratch resistance |
|---|---|---|---|---|
| EX 1 | Excellent | Very good | Very good | Good |
| EX 2 | Excellent | Very good | Very good | Good |
| EX 3 | Excellent | Very good | Very good | Good |
| EX 4 | Excellent | Very good | Very good | Good |
| EX 5 | Very good | Very good | Very good | Good |
| EX 6 | Very good | Very good | Very good | Good |
| EX 7 | Excellent | Very good | Very good | Good |
| EX 8 | Excellent | Very good | Very good | Good |
| EX 9 | Excellent | Good | Good | Good |
| EX 10 | Very good | Good | Good | Good |
| EX 11 | Excellent | Very good | Very good | Good |
| EX 12 | Excellent | Very good | Very good | Good |
| EX 13 | Excellent | Good | Good | Good |
| EX 14 | Very good | Very good | Very good | Good |
| EX 15 | Excellent | Very good | Very good | Good |
| EX 16 | Excellent | Very good | Very good | Good |
| EX 17 | Excellent | Good | Good | Good |
| EX 18 | Excellent | Fair | Fair | Good |
| EX 19 | Excellent | Good | Good | Good |
| EX 20 | Excellent | Very good | Very good | Good |
| EX 21 | Excellent | Very good | Very good | Good |
| EX 22 | Excellent | Very good | Very good | Good |
| EX 23 | Excellent | Very good | Very good | Good |
| EX 24 | Very good | Very good | Very good | Good |
| EX 25 | Good | Very good | Very good | Good |
| EX 26 | Good | Very good | Very good | Good |
| EX 27 | Very good | Very good | Very good | Good |
| EX 28 | Excellent | Very good | Very good | Good |
| CE 1 | Poor | Very good | Very good | Good |
| CE 2 | Poor | Very good | Very good | Good |
| CE 3 | Excellent | Poor | Poor | Good |
| CE 4 | Excellent | Poor | Poor | Good |
| CE 5 | Excellent | Poor | Poor | Good |
| CE 6 | Excellent | Poor | Poor | Good |
| CE 7 | Poor | Very good | Very good | Good |
| CE 8 | Excellent | Poor | Poor | Good |
| CE 9 | Excellent | Poor | Poor | Good |
| CE 10 | Excellent | Very good | Very good | Poor |
| CE 11 | Poor | Very good | Very good | Good |
| CE 12 | Excellent | Poor | Poor | Poor |
| CE 13 | Excellent | Poor | Poor | Poor |
| CE 14 | Excellent | Poor | Poor | Poor |
| CE 15 | Excellent | Poor | Poor | Poor |
| CE 16 | Excellent | Poor | Poor | Poor |
| CE 17 | Very poor | Very good | Very good | Good |
| CE 18 | Extremely poor | Very good | Very good | Good |
| CE 19 | Extremely poor | Very good | Very good | Good |
| CE 20 | Very poor | Very good | Very good | Good |
| CE 21 | Poor | Very good | Very good | Good |

Table 3 revealed that in the lithographic printing plates and presensitized plates in Examples 1 to 28 obtained using the lithographic printing plate supports each having an anodized aluminum film in which micropores having specified average diameters and depths were formed, the press life, deinking ability after suspended printing, on-press developability and scratch resistance were excellent. The large-diameter portions and small-diameter portions making up the micropores obtained in Examples 1 to 28 each had a substantially straight tubular shape and the large-diameter portions had a curved (substantially hemispherical) bottom.

It was confirmed that more beneficial effects are obtained particularly in Examples 3 and 4 in which the average diameter of the large-diameter portions is within a predetermined range. It was also confirmed that more beneficial effects are obtained particularly in Examples 7 and 8 in which the depth of the large-diameter portions is within a predetermined range, Examples 11 and 12 in which the ratio of the depth to the average diameter of the large-diameter portions is within a predetermined range, and Examples 15 and 16 in which the micropore density is within a predetermined range.

On the other hand, the results obtained in Comparative Examples 1 to 21 which do not meet the requirements of the average diameter and the depth of the invention were inferior to those in Examples 1 to 28.

Particularly in Comparative Examples 12 to 16 in which Examples 1 to 5 specifically disclosed in JP 11-291657 A were performed, the deinking ability after suspended printing and on-press developability were poor.

Description of Symbols

1, 12 aluminum plate
2,4 roller-type brush
3 abrasive slurry
5,6,7,8 support roller
ta anodic reaction time
tc cathodic reaction time
tp time required for the current to reach a peak from zero
Ia peak current on the anode cycle side
Ic peak current on the cathode cycle side
10 lithographic printing plate support
14, 14*a*, 14*b*, 14*c* anodized aluminum film
16, 16*a*, 16*b*, 16*c* micropore
18 large-diameter portion
20 small-diameter portion
50 main electrolytic cell
51 AC power supply
52 radial drum roller
53*a*, 53*b* main electrode
54 solution feed inlet
55 electrolytic solution
56 auxiliary anode
60 auxiliary anode cell
W aluminum plate
610 anodizing apparatus
612 power supply cell
614 electrolytic cell
616 aluminum plate
618, 626 electrolytic solution
620 power supply electrode
622, 628 roller
624 nip roller
630 electrolytic electrode
632 cell wall
634 DC power supply

What is claimed is:

1. A lithographic printing plate support comprising: an aluminum plate; and an aluminum anodized film formed on the aluminum plate and having micropores which extend in a depth direction of the anodized film from a surface of the anodized film opposite from the aluminum plate, wherein each of the micropores has a large-diameter portion which extends to a depth of 5 to 60 nm (depth A) from the surface of the anodized film and a small-diameter portion which communicates with a bottom of the large-diameter portion and extends to a depth of 900 to 2,000 nm from a communication position, wherein an average diameter of the large-diameter portion at the surface of the anodized film is from 10 to 60 nm and a ratio of the depth A to the average diameter of the large-diameter portion (depth A/average diameter) is from 0.1 to 4.0, wherein a communication position average diameter of the small-diameter portion is more than 0 but less than 20 nm, and wherein a ratio of the average diameter of the small-diameter portion to the average diameter of the large-diameter portion (small-diameter portion diameter/large-diameter portion diameter) is up to 0.85.

2. The lithographic printing plate support according to claim 1, wherein the average diameter of the large-diameter portion is from 10 to 50 nm.

3. The lithographic printing plate support according to claim 1 wherein the depth A is from 10 to 50 nm.

4. The lithographic printing plate support according to claim 1, wherein the ratio of the depth A to the average diameter of the large-diameter portion is at least 0.30 but less than 3.0.

5. The lithographic printing plate support according to claim 1, wherein the micropores are formed at a density of 100 to 3,000 pcs/$\mu m^2$.

6. A lithographic printing plate support-manufacturing method for manufacturing the lithographic printing plate support according to claim 1, comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

7. The lithographic printing plate support-manufacturing method according to claim 6, wherein a ratio between a thickness of the anodized film obtained in the first anodizing treatment step (first film thickness) and a thickness of the anodized film obtained in the second anodizing treatment step (second film thickness) (first film thickness / second film thickness) is from 0.01 to 0.15.

8. The lithographic printing plate support-manufacturing method according to claim 6, wherein the thickness of the anodized film obtained in the second anodizing treatment step is from 900 to 2,000 nm.

9. A presensitized plate comprising: the lithographic printing plate support according to claim 1; and an image recording layer formed thereon.

10. The presensitized plate according to claim 9, wherein the image recording layer is one in which an image is formed by exposure to light and unexposed portions are removable with printing ink and/or fountain solution.

11. The lithographic printing plate support according to claim 2 wherein the depth A is from 10 to 50 nm.

12. The lithographic printing plate support according to claim 2, wherein the ratio of the depth A to the average diameter of the large-diameter portion is at least 0.30 but less than 3.0.

13. The lithographic printing plate support according to claim 3, wherein the ratio of the depth A to the average diameter of the large-diameter portion is at least 0.30 but less than 3.0.

14. The lithographic printing plate support according to claim 2, wherein the micropores are formed at a density of 100 to 3,000 pcs/$\mu m^2$.

15. The lithographic printing plate support according to claim 3, wherein the micropores are formed at a density of 100 to 3,000 pcs/$\mu m^2$.

16. The lithographic printing plate support according to claim 4, wherein the micropores are formed at a density of 100 to 3,000 pcs/$\mu m^2$.

17. A lithographic printing plate support-manufacturing method for manufacturing the lithographic printing plate support according to claim 2, comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

18. A lithographic printing plate support-manufacturing method for manufacturing the lithographic printing plate support according to claim 3, comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

19. A lithographic printing plate support-manufacturing method for manufacturing the lithographic printing plate support according to claim 4, comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

20. A lithographic printing plate support-manufacturing method for manufacturing the lithographic printing plate support according to claim 5, comprising:

a first anodizing treatment step for anodizing an aluminum plate;

a pore-widening treatment step for increasing a diameter of micropores in an anodized film by bringing the aluminum plate having the anodized film obtained in the first anodizing treatment step into contact with an aqueous acid or alkali solution; and a second anodizing treatment step for anodizing the aluminum plate obtained in the pore-widening treatment step.

* * * * *